US010329651B2

(12) United States Patent
Nadendla et al.

(10) Patent No.: US 10,329,651 B2
(45) Date of Patent: Jun. 25, 2019

(54) METHOD OF REFINING METAL ALLOYS

(75) Inventors: Hari Babu Nadendla, Uxbridge (GB); Magdalena Nowak, Uxbridge (GB)

(73) Assignee: Brunel University London (GB)

( * ) Notice: Subject to any disclaimer, the term of this patent is extended or adjusted under 35 U.S.C. 154(b) by 488 days.

(21) Appl. No.: 13/822,870

(22) PCT Filed: Feb. 10, 2012

(86) PCT No.: PCT/GB2012/050300

§ 371 (c)(1),
(2), (4) Date: May 28, 2013

(87) PCT Pub. No.: WO2012/110788

PCT Pub. Date: Aug. 23, 2012

(65) Prior Publication Data

US 2013/0248050 A1 Sep. 26, 2013

(30) Foreign Application Priority Data

Feb. 18, 2011 (GB) ..... 1102849.5

(51) Int. Cl.

| | |
|---|---|
| ***C22F 1/043*** | (2006.01) |
| ***B22D 21/00*** | (2006.01) |
| ***B22D 21/04*** | (2006.01) |
| ***B22D 27/20*** | (2006.01) |
| ***C22C 1/10*** | (2006.01) |
| ***C22C 1/03*** | (2006.01) |
| ***C22C 21/02*** | (2006.01) |
| ***C22F 1/04*** | (2006.01) |

(52) U.S. Cl.

CPC ..... *C22F 1/043* (2013.01); *B22D 21/007* (2013.01); *B22D 21/04* (2013.01); *B22D 27/20* (2013.01); *C22C 1/03* (2013.01); *C22C 1/1026* (2013.01); *C22C 21/02* (2013.01); *C22F 1/04* (2013.01)

(58) Field of Classification Search

CPC ..... C22C 1/00; C22C 32/00

USPC ..... 148/549, 688, 407, 415, 328; 420/407, 420/528, 534, 537, 129, 590, 552

See application file for complete search history.

(56) References Cited

U.S. PATENT DOCUMENTS

| | | | | |
|---|---|---|---|---|
| 3,591,527 | A | 7/1971 | Murata | |
| 3,933,476 | A | 1/1976 | Chopra et al. | |
| 4,915,903 | A * | 4/1990 | Brupbacher et al. | 420/129 |
| 6,332,933 | B1 * | 12/2001 | Ma | B82Y 25/00 148/101 |
| 6,416,598 | B1 | 7/2002 | Sircar | |
| 2005/0016709 | A1 | 1/2005 | Saha et al. | |
| 2008/0219882 | A1 | 9/2008 | Woydt | |
| 2010/0143177 | A1 * | 6/2010 | Pandey | 419/30 |

FOREIGN PATENT DOCUMENTS

| | | | |
|---|---|---|---|
| EP | 0195341 | A1 | 9/1986 |
| EP | 0265307 | A1 | 4/1988 |
| EP | 0487276 | A1 | 5/1992 |
| EP | 1205567 | A2 | 5/2002 |
| EP | 1978120 | A1 | 10/2008 |
| EP | 2112242 | A1 | 10/2009 |
| GB | 563617 | A | 8/1944 |
| GB | 595214 | A | 11/1947 |
| GB | 595531 | A | 12/1947 |
| GB | 605282 | A | 7/1948 |
| GB | 1244082 | A | 8/1971 |
| JP | 57-098647 | A | 6/1982 |
| SU | 519487 | A1 | 6/1976 |
| WO | WO 91/02100 | A1 | 2/1991 |
| WO | WO 2004/099455 | A2 | 11/2004 |
| WO | WO 2010/077735 | A2 | 7/2010 |

OTHER PUBLICATIONS

HE Calderon, "TMS 2008, 137$^{th}$, Annual Meeting & Exhibition, Supplemental Proceedings," 2008, Metals & Materials Society, pp. 425-430, "Innoculation of aluminium alloyws with nanosized borides and microstructural analysis".

Almeida, A, et al., "Structure and properties of Al—Nb alloys produced by laser surface alloying," Materials Science and Engineering A: Structural Materials: Properties, Microstructure & Processing, Lausanne, Ch, vol. 303, No. 1-2, May 15, 2001, pp. 273-280, XP027361965.

Petrov, P., "Laser beam induced surface alloying of aluminum with niobium," Journal of Physics: Conference Series, Institute of Physics Publishing, Bristol, GB, vol. 113, No. 1, May 1, 2008, p. 12048, XP020139366.

* cited by examiner

*Primary Examiner* — Jenny R Wu

(74) *Attorney, Agent, or Firm* — Joseph T. Leone, Esq.; DeWitt LLP

(57) ABSTRACT

Method of refining metal alloys A method of refining the grain size of (i) an alloy comprising aluminum and at least 3% w/w silicon or (ii) an alloy comprising magnesium, comprises the steps of (a) adding sufficient niobium and boron to the alloy in order to form niobium diboride or $Al_3Nb$ or both, or (b) adding niobium diboride to the alloy, or (c) adding $Al_3Nb$ to the alloy, or (d) any combination thereof.

6 Claims, 43 Drawing Sheets c)

a)

b)

a)

b)

c)

METHOD OF REFINING METAL ALLOYS

CROSS-REFERENCE TO RELATED APPLICATIONS

Priority is hereby claimed to co-pending International Application No. PCT/GB2012/050300, filed 10 Feb. 2012, which claims priority to GB Serial No. 1102849.5, filed 18 Feb. 2011, both of which are incorporated herein by reference.

The present application relates to a method of refining the grain size of a metal alloy, and in particular a method for refining the grain size of aluminium-silicon alloys and magnesium alloys (both including and excluding aluminium).

An important objective in the production of metal alloys is the reduction in grain size of the final product. This is known as "grain refinement" and is commonly addressed by adding so-called "grain refiners" which are substances thought to promote inoculation of metal alloy crystals. Grain refinement by inoculation brings many benefits in the casting process and has significant influence on improving mechanical properties. The fine equiaxed grain structure imparts high yield strength, high toughness, good extrudability, uniform distribution of the second phase and microporosity on a fine scale. This in turn results in improved machinability, good surface finish and resistance to hot tearing (along with various other desirable properties).

Aluminium is a relatively light metal and is therefore an important component of metal alloys. There are two groups of aluminium alloys, namely wrought alloys and casting alloys. For wrought alloys, titanium-based grain refiners such as Al—Ti—B (in the form of Al-xTi-yB with $0 \leq x \leq 5$ and $0 \leq y \leq 2$) and Al—Ti—C based master alloys are commonly used. However, for casting alloys, the addition of titanium-based grain refiners is less effective, particularly in the case of aluminium-silicon alloys with a silicon content above 3%. When the silicon level is above 3%, it is believed that the positioning effect (consumption of titanium by the formation of Ti—Si compounds) takes place.

It is important to note that the most aluminium casting alloys include silicon at levels well above 3 wt %. In Britain, for example, most cast aluminium alloy components are made from only few alloys designated as LM2, LM4, LM6, LM21, LM24 and LM25. In all these alloys silicon levels are between 6 wt % and 12 wt %.

Depending on silicon concentration, aluminium-silicon alloys are classified as hypo-eutectic (Si<12 wt %) such as LM2 LM4, LM6, LM21, LM24 and LM25 mentioned above or hyper-eutectic (Si>12%). Hypereutectic Al—Si alloys have excellent wear and corrosion resistance, lower density and higher thermal stability. These alloys have been widely used for wear-resistant applications (such as piston alloys). In a hypereutectic system the primary phase is silicon and it exhibits irregular morphologies such as coarse platelets and polygons, which have detrimental effects on the fracture toughness of hypereutectic Al—Si alloys. Therefore, these silicon particles must be effectively refined.

Phosphorus is well accepted as one of the most effective refiners of primary silicon (at addition levels of a few ppm) and is generally used due to formation of aluminium phosphide (AlP) particles (with a lattice parameter a=0.545 nm) in the melt. It is suggested that silicon can nucleate heterogeneously on a substrate of AlP with a cube-cube orientation relationship and solidify to form a faceted silicon particle due to the very similar parameters with AlP. Addition of phosphorous is observed to refine the grain size of silicon from about 100 μm to 30 μm under practical solidification conditions. However, phosphorus does not refine the grain size of alloys with a eutectic structure. In addition, for better wear-resistant applications, particularly at high temperatures, it is important to refine further the grain size of primary silicon.

Magnesium is the lightest structural metal and is therefore used in many important industrial alloys. As with aluminium alloys, the addition of grain refiners to the magnesium alloy melt before a casting process has been regarded as an important method to optimize the grain size of commercial castings. The use of grain refiners not only enhances the mechanical properties of the alloy but also induces a uniform distribution of intermetallics and solute elements in order to improve machinability, gives a good surface finish, a favorable resistance to hot tearing and a prominent extrudability.

Zirconium has been found to be an effective grain refiner for aluminium-free magnesium alloys (such as ZE43, ZK60 and WE43). However, it has not been possible to employ zirconium as a grain refiner for aluminium-containing magnesium alloys (AZ series alloys and AM series alloys) due to the undesirable reaction between zirconium and aluminium forming stable intermetallic phases which adversely effects grain size refinement. Moreover, although carbon inoculants (such as graphite, $Al_4C_3$ or SiC) are observed to refine the grain size of Al containing Mg commercial alloys, such chemical additives are not commercially used in the magnesium industry, due to processing difficulties associated with mixing carbon-based phases uniformly in large quantities of liquid. Specifically, it is not possible to produce a master alloy because of stability problems, and the grain refinement of magnesium alloys is not sufficient.

Various prior art references include long lists of alloyants which are thought to act as hardness or grain refiners. See for example GB 595,214 (Brimelow); GB 595,531 (Bradbury); GB 605,282 (The National Smelting Company); GB 563,617 (The National Smelting Company); EP 0 265 307 A1 (Automobiles Peugeot); US 2005/0016709 A1 (Saha); US 2008/0219882 A1 (Woydt); EP 1 205 567 A2 (Alcoa, Inc.) and WO 91/02100 (Comalco). However, none of these prior art references disclose examples of alloys which include both niobium and boron in elemental form, let alone niobium diboride as required by the present invention.

JP 57-098647 (Nissan Motor) discloses an aluminium alloy material with superior wear resistance to which it is disclosed that various materials may be added as solid lubricants or wear-resistant materials, among them NbB. There does not appear to be any disclosure of using $NbB_2$ as a grain refiner.

There are various prior art references which disclose the use of grain refiners for aluminium alloys having low amounts of silicon as an alloyant (typically less than 3 wt %), for example GB 1244082 (Kawecki); GB 605282 (National); GB 595531 (Bradbury); GB 563617 (National); and HE Calderon, "TMS 2008, 137$^{th}$ Annual Meeting & Exhibition, Supplemental Proceedings", 2008, Metals & Materials Society, pp. 425-430, "Innoculation of aluminium alloys with nanosized borides and microstructural analysis". U.S. Pat. No. 6,416,598 (Sircar) discloses the use of high melting point constituents to provide enhanced machining capability of low silicon content aluminium alloys. However, as noted above, the particular technical problems addressed by the present invention are in relation to aluminium alloys having silicon levels higher than 3 wt %.

SU 519487 (Petrov) discloses an aluminium-based alloy including silicon, copper, magnesium, manganese, titanium and boron to which zirconium, niobium, molybdenum, cadmium, barium, calcium, sodium and potassium have been added in specific ratios in order to improve the mechanical properties and manufacturability of the alloy.

Although the Petrov reference discloses an alloy which may be formed with trace elements of niobium and boron, it is not believed that any niobium diboride is formed because the niobium and boron atoms preferentially react with other elements. Specifically, based on enthalpies of formation of titanium boride, zirconium boride and niobium diboride, we believe that niobium diboride does not form in Petrov's alloy.

For example, the maximum amount of titanium present in Petrov's alloy (0.2 wt %) takes about 0.09 wt % of boron atoms to form titanium boride, whereas the maximum amount of boron in specified to be present is lower than this (0.05 wt %). As a result of titanium boride formation, therefore, there will not be any boron left in Petrov's alloy to form niobium diboride.

In addition, the maximum amount of zirconium which can be present (0.2 wt %) reacts with about 0.047 wt % boron atoms to form zirconium boride. This is close to the maximum of boron atoms which can be present (0.05 wt %).

Petrov's alloy also contains calcium. Formation of calcium boride ($CaB_6$) consumes a significant amount of boron, and it is thought that this happens preferentially.

In accordance with a first aspect of the present invention, there is provided the use of niobium diboride to refine the grain of (i) an alloy comprising aluminium and at least 3% w/w silicon or (ii) an alloy comprising magnesium. The alloy comprising magnesium may for example additionally comprise aluminium or be aluminium-free.

By "niobium diboride" is meant a compound formed of one mole of niobium to two moles of boron represented by the formula $NbB_2$, and not the equivalent compound formed of one mole of niobium to one mole of boron represented by the formula NbB. When Nb and B are added with $NbB_2$ molar ratio, phase diagrams suggests NbB does not form. The crystal structure of NbB is orthorhombic (3.298 Å, 8.724 Å, 3.166 Å) and is not likely to act as an effective nucleation site for aluminium.

Without wishing to be constrained by theory, it is believed that niobium diboride forms fine phase inclusions and that certain planes of these inclusions act as heterogeneous nucleation sites for the alloy. However, in order to refine the grain of aluminium-silicon alloys, it is strongly preferred that a phase of $Al_3Nb$ is also present. Again, without wishing to be constrained by theory, it believed that a layer of $Al_3Nb$ may form at the $NbB_2$ melt interface which layer can in turn can nucleate Al grain.

In the case of alloys comprising magnesium, it is believed that, when niobium and boron a niobium diboride phase is responsible for the observed grain refinement. It is unlikely (though not impossible) that an $Al_3Nb$ phase forms in aluminium-containing magnesium alloys. Experiments have shown that the addition of niobium and boron to aluminium-free magnesium alloys does result in grain refinement.

Accordingly, in a second aspect of the invention, there is provided a method of refining the grain size of (i) an alloy comprising aluminium and at least 3% w/w silicon or (ii) an alloy comprising magnesium, comprising the steps of (a) adding sufficient niobium and boron to the alloy in order to form niobium diboride or $Al_3Nb$ or both, or (b) adding niobium diboride to the alloy, or (c) adding $Al_3Nb$ to the alloy, or (d) any combination thereof.

In a third aspect of the invention, there is provided a method of refining the grain size of (i) an alloy comprising aluminium and at least 3% w/w silicon or (ii) an alloy comprising magnesium, comprising the steps of (a) adding sufficient niobium and boron to a portion of a first alloy in order to form niobium diboride or $Al_3Nb$ or both, and (b) adding the product of step (a) to a portion of a second alloy, wherein the first and second alloy are the same or different.

In other words, the alloy may be refined by first producing a masterbatch (a small portion of an alloy comprising the grain refiner) and then adding this masterbatch to the bulk alloy.

In a fourth aspect of the invention, there is provided a method of producing a masterbatch alloy for refining the grain size of a bulk alloy which is (i) an alloy comprising aluminium and at least 3% w/w silicon or (ii) an alloy comprising magnesium, comprising the step of:

(a) adding sufficient niobium and boron to a portion of the alloy in order to form niobium diboride or $Al_3Nb$ or both.

For example, a masterbatch for adding to an aluminium alloy may have the general formula Al—(X wt % (Nb:2B in molar ratio) where X can be from 0.1 to a very high number (perhaps as much as 99). In an alternative embodiment, the masterbatch may comprise elemental niobium and boron in amounts sufficient to form sufficient niobium diboride in the final alloy product.

The alloy used in the present method is preferably an aluminium-silicon alloy (most preferably an aluminium-silicon alloy such as LM6) or a magnesium alloy (most preferably a magnesium-aluminium alloy such as AZ91D) but the method may be used with any alloy for which grain refinement is required.

In a preferred embodiment, the alloy which is being refined comprises aluminium and silicon and at least some of the niobium diboride reacts to form $Al_3Nb$. Alternatively or additionally, the $Al_3Nb$ can be formed directly from aluminium and niobium.

In one embodiment, the amount of niobium diboride is at least 0.001% by weight of the alloy. In another embodiment, the amount of niobium diboride is no more than 10% by weight of the alloy.

When the present method is employed to refine the grain of any aluminium-silicon alloy having at least 3 wt % aluminium, it is preferably used in alloys with from 3 to 25 wt % silicon.

In a fifth aspect of the invention, there is provided the use of $Al_3Nb$ to refine the grain of alloys comprising aluminium and at least 3% w/w silicon.

In a fifth aspect of the invention, there is provided an obtainable by the method or use as defined above.

Niobium diboride grain refiner is observed to refine grain size significantly and it is expected that it could play a key role in the wider use of lightweight aluminium instead of steel and cast iron in transport vehicles. It is important to note that, to have better fluidity, castings will be normally carried around 40° C. superheat, which is 700° C. for commercial pure aluminium. Superheat normally refers to the temperature of the liquid above the melting temperature of the alloy. The melting temperature of commercial pure Al is 660° C. Fluidity of alloy increases as the temperature increases. Normally, from the viewpoint of better fluidity, the casting temperature would be in the range from 40° C. to 100° C. above the melting temperature depending on alloy. So, in industry, commercial pure Al or dilute Al alloys are cast at least 40° C. superheat temperatures. Note that very high superheat is not a good choice because the risk of melt oxidation is severe.

A number of preferred embodiments of the invention will now be described with reference to the drawings, in which:

FIG. 1 is a graph showing grain size as a function of amount of niobium diboride for an LM6 alloy. This amount represents the starting composition of the masterbatch alloy. The actual $NbB_2$ concentration could be much lower;

Figure 5:
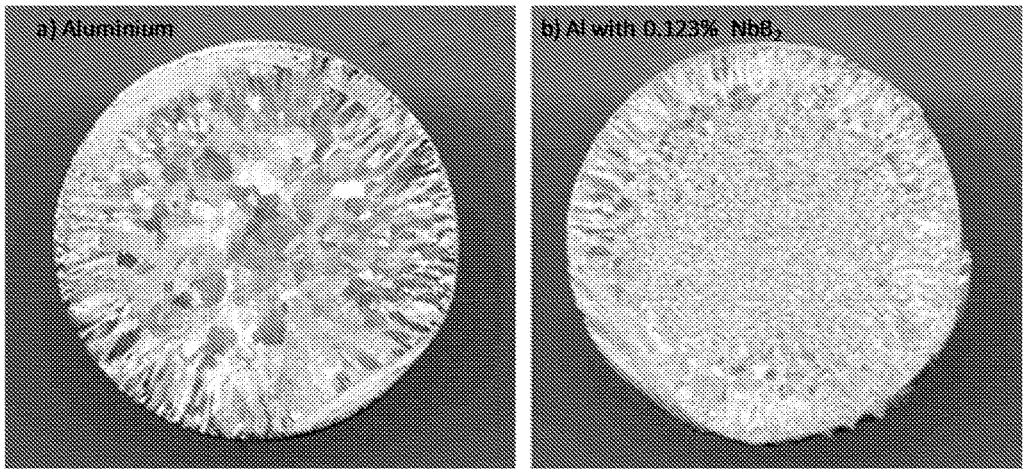
Figure 5:
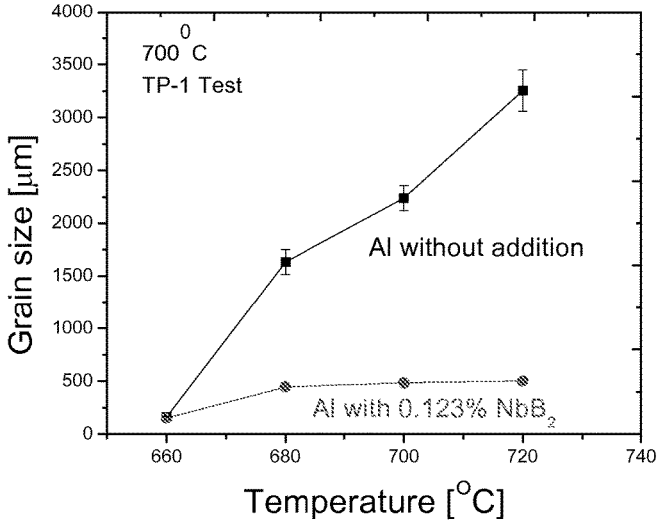
Figure 6:
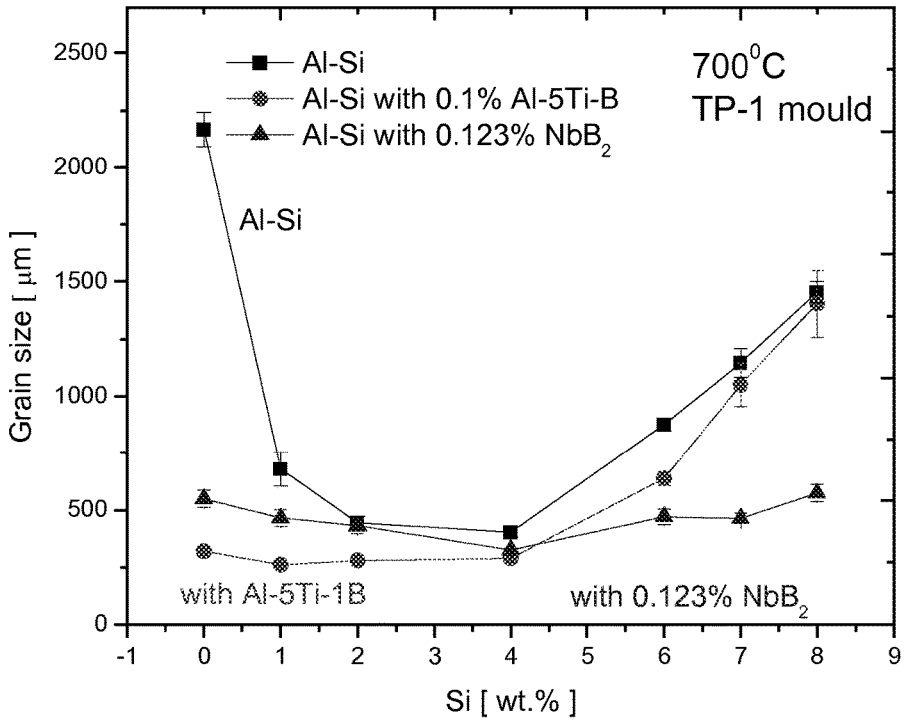
Figure 6:
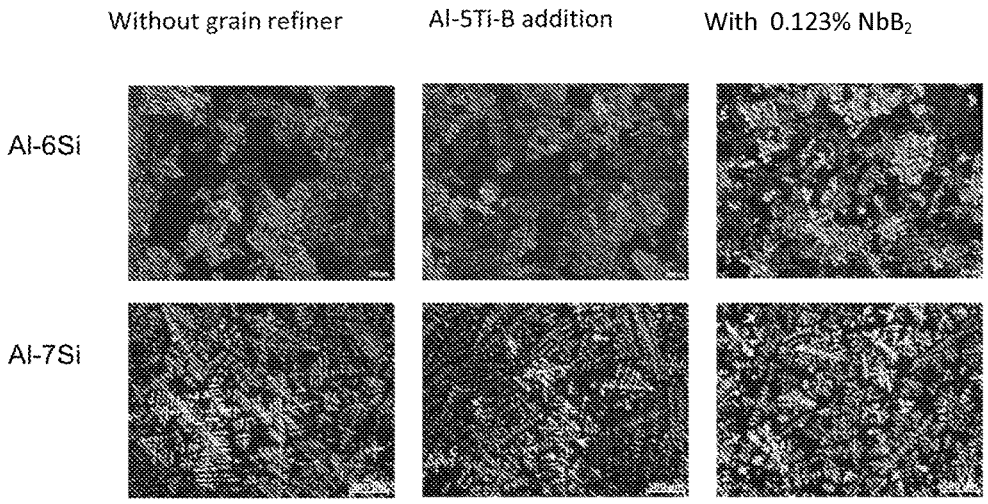
Figure 7:
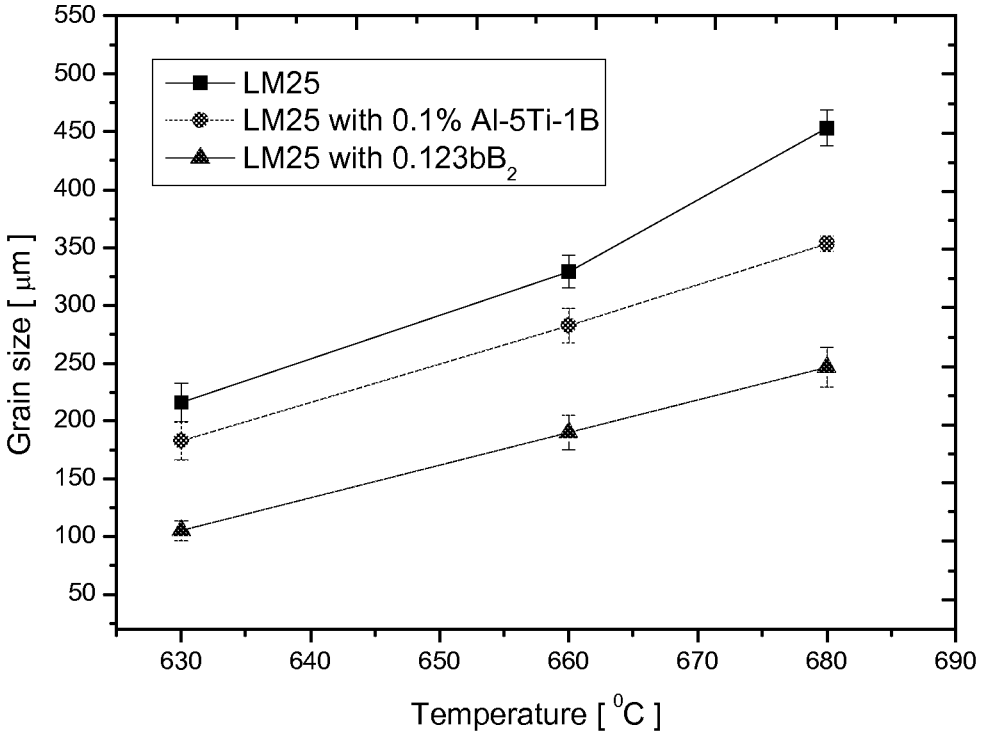
Figure 8:
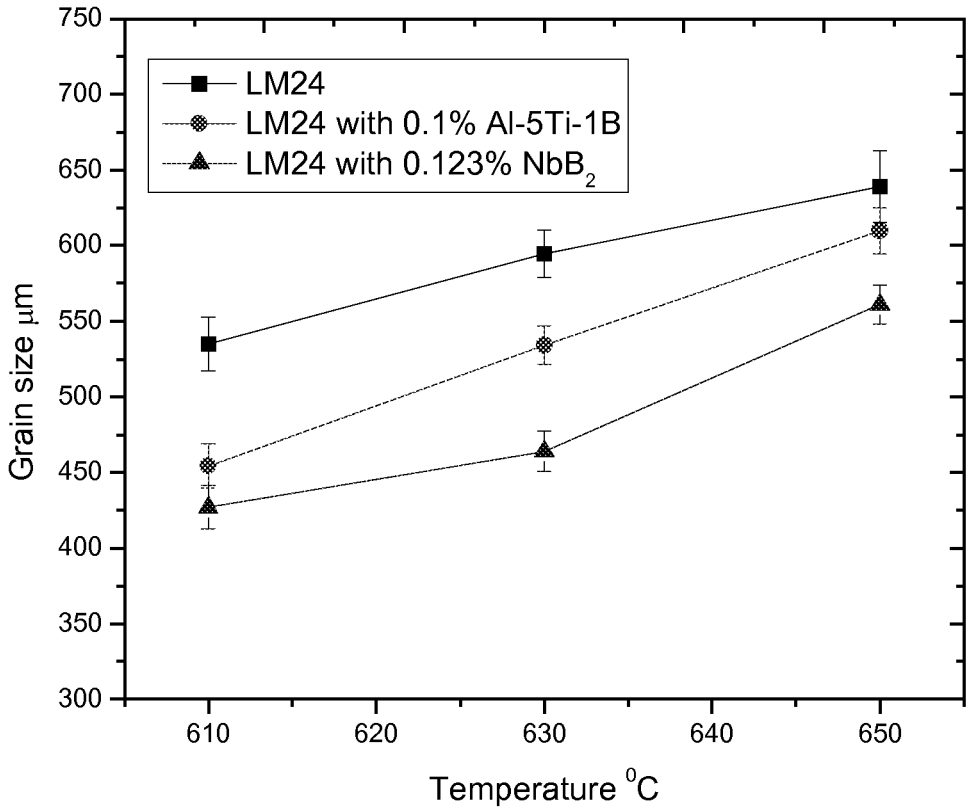
Figure 9:
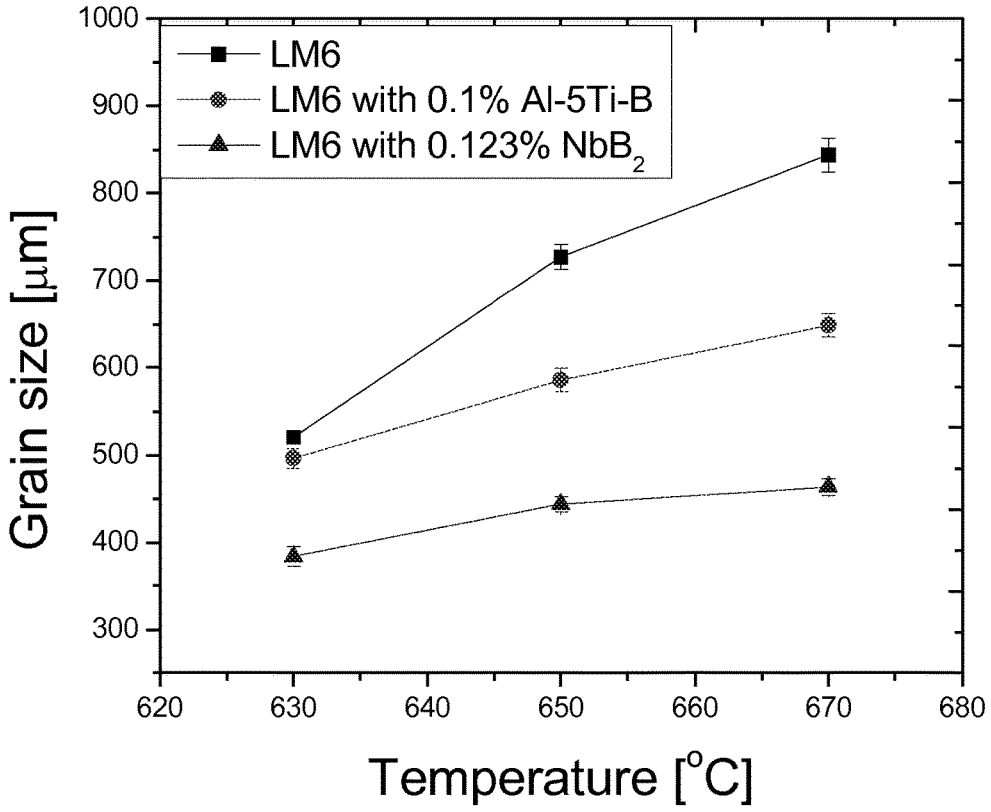
Figure 10:
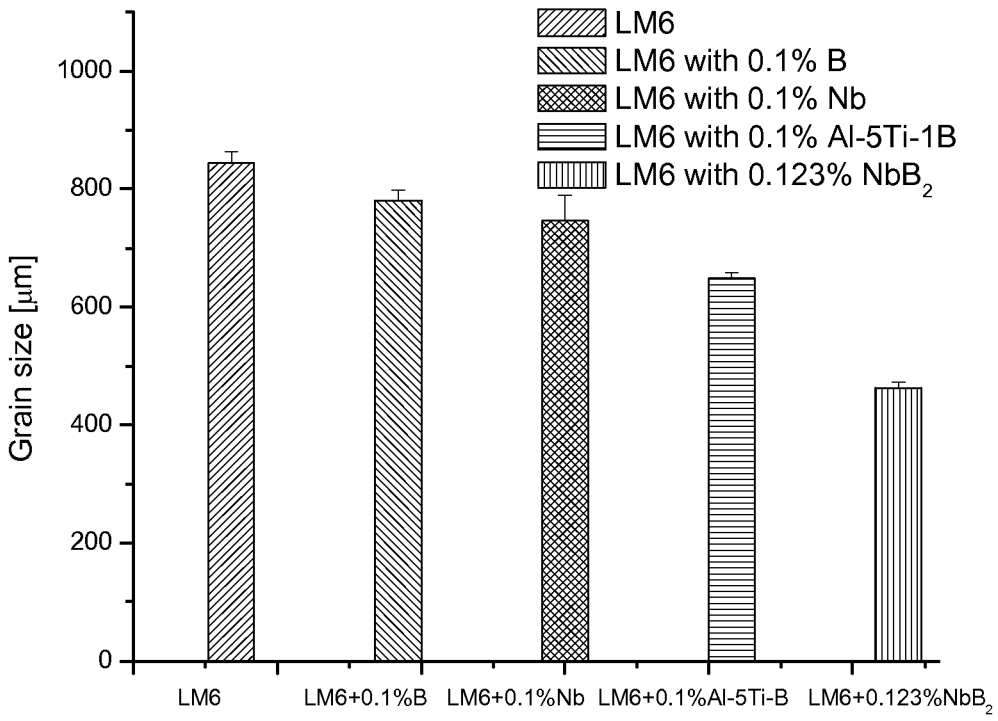
Figure 11:
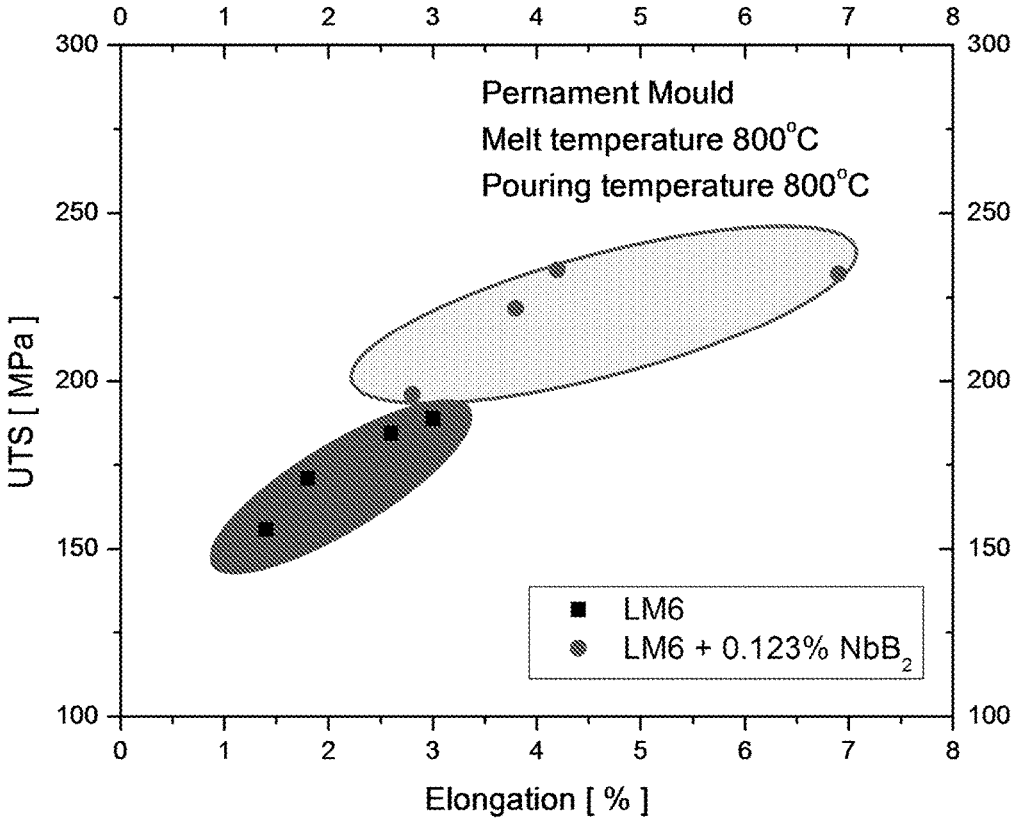
Figure 12:
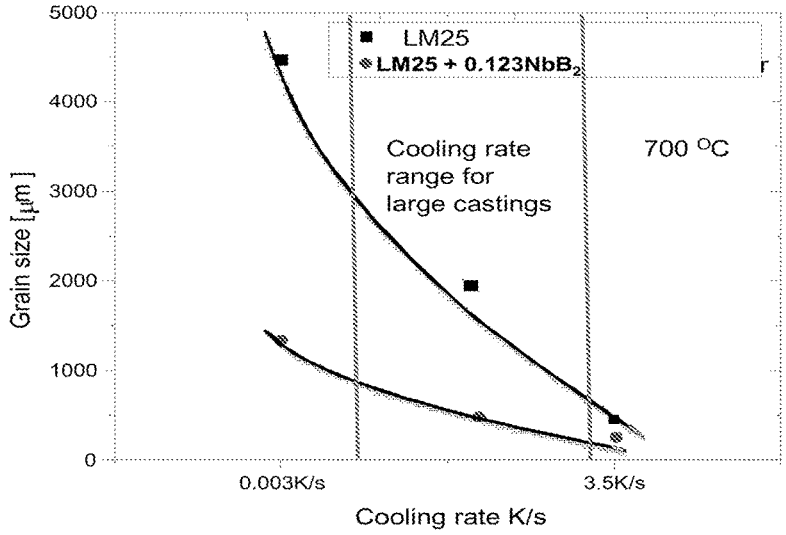
Figure 12:
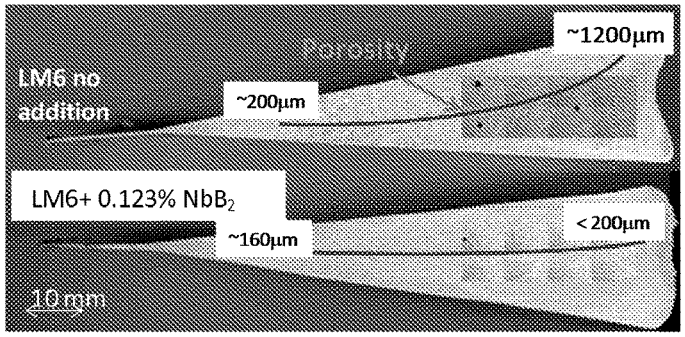
Figure 12:
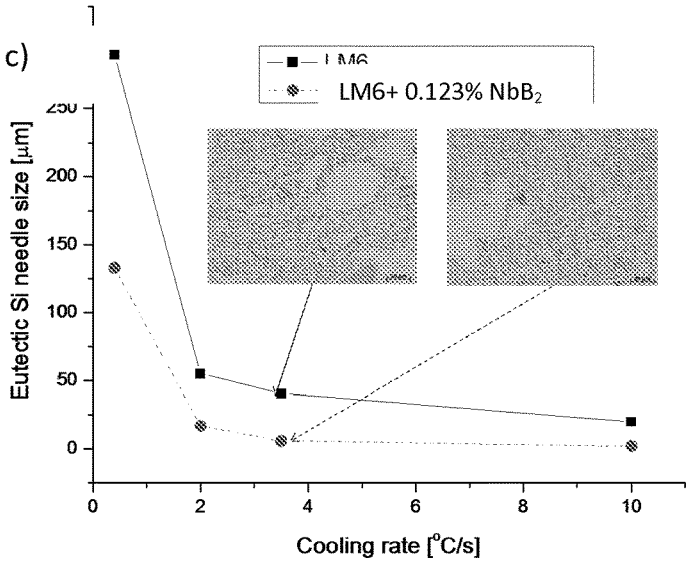
Figure 13:
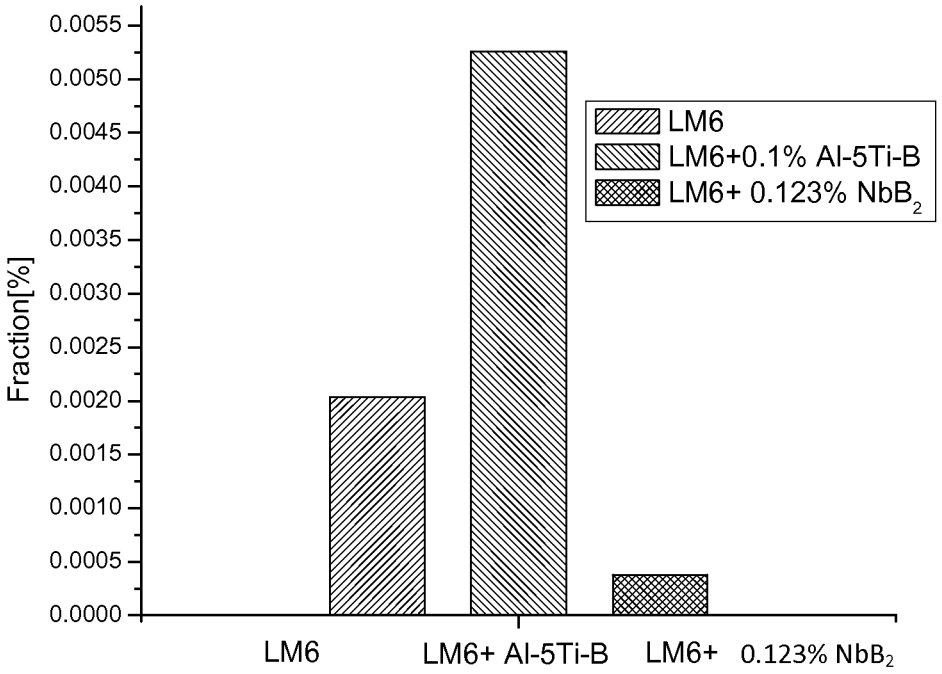
Figure 14:
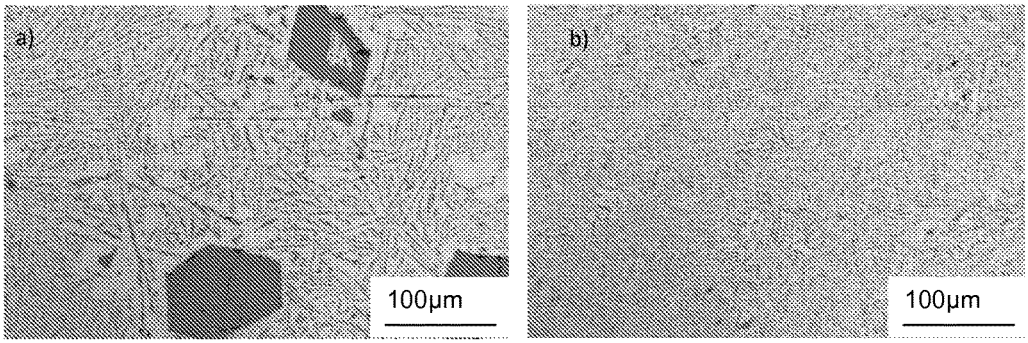

FIGS. 5 (*a*) and (*b*) are photographs of specimens of commercially pure aluminium without and with niobium and boron as a grain refiner; FIG. 5 (*c*) is a graph of grain size as a function of pouring temperature for the specimens of (*a*) and (*b*);

FIG. 6 (*a*) is a graph of grain size as a function of type of grain refiner for alloys with differing amounts of silicon;

FIG. 6 (*b*) shows micrographs of two different aluminium alloys showing grain size;

FIG. 7 is a graph showing grain size as a function of pouring temperature for an LM25 alloy depending on type of grain refiner;

FIG. 8 is a graph showing grain size as a function of pouring temperature for an LM24 alloy depending on type of grain refiner;

FIG. 9 is a graph showing grain size as a function of pouring temperature for an LM6 alloy depending on type of grain refiner;

FIG. 10 is a bar chart showing grain size as a function of type of grain refiner added to an LM6 alloy;

FIG. 11 is graph plotted for elongation and ultimate tensile strength (UTS);

FIG. 12 (*a*) is a graph showing grain size as a function of cooling rate for an LM25 alloy with and without a niobium grain refiner;

FIG. 12 (*b*) shows photographs of an LM6 alloy specimens formed with and without a niobium diboride grain refiner to demonstrate the effect cooling rates have on grain size;

FIG. 12 (*c*) is a graph of eutectic Si needle size as a function of cooling rate. Two microstructures are also shown to reveal differences in the eutectic grain structure;

FIG. 13 is a bar chart showing the area fraction of porosity as a function of the type of grain refiner added to an LM6 alloy;

FIG. 14 is a microstructure of Al-14Si alloy (a) without and (b) with 0.1 wt % Nb+0.1 wt % B.

Figure 15:
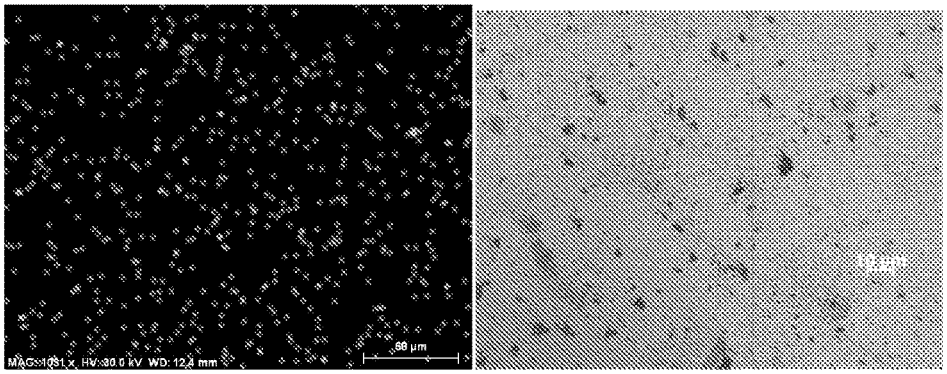
Figure 16:
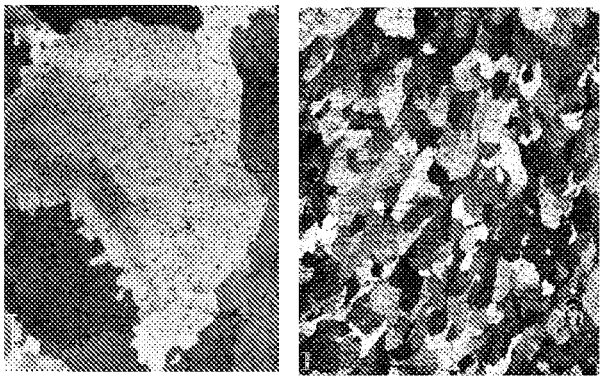

FIG. 15 shows SEM and optical micrographs of an Al—Nb—B master alloy;

FIG. 16 shows the grain structure of a commercially pure Al alloy (a) without and (b) with the addition of Al—Nb—B master alloy.

Figure 17:
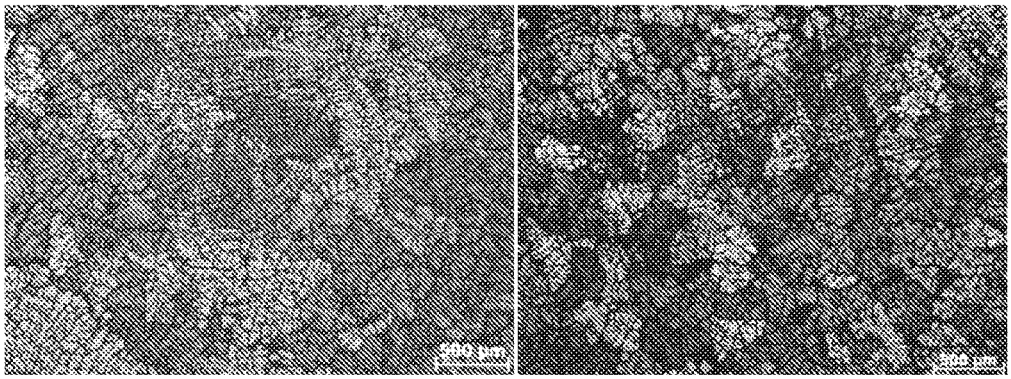
Figure 18:
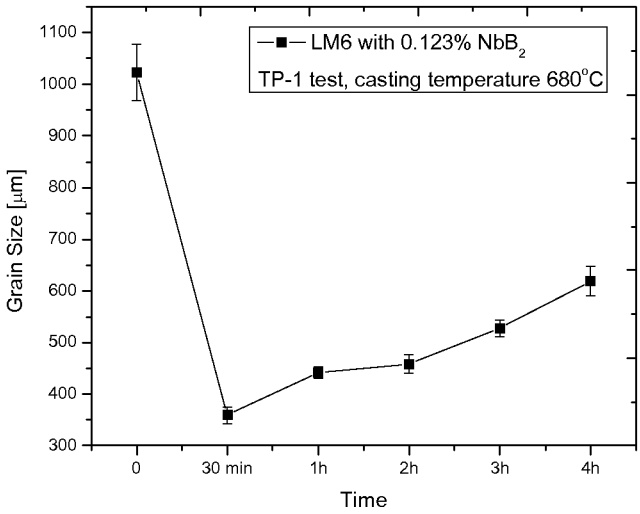

FIG. 17 shows micrographs of an LM25 alloy microstructure without and with an Al—Nb—B master alloy;

FIG. 18 is a graph showing grain size as a function of holding time for an LM6 alloy having a niobium diboride grain refiner.

Figure 19:
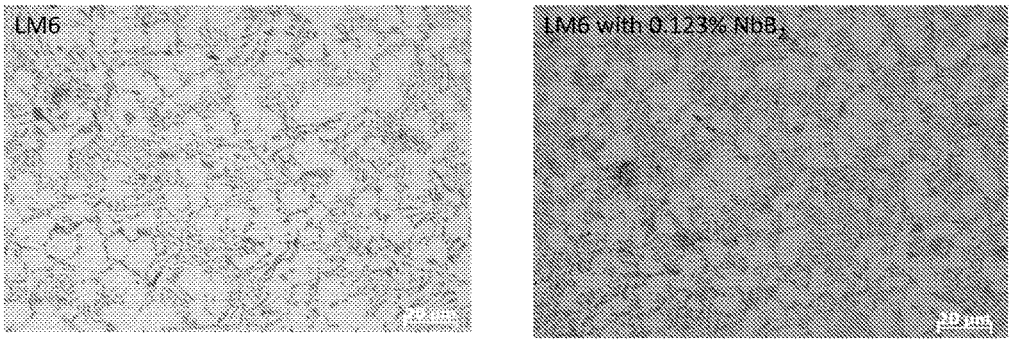
Figure 20:
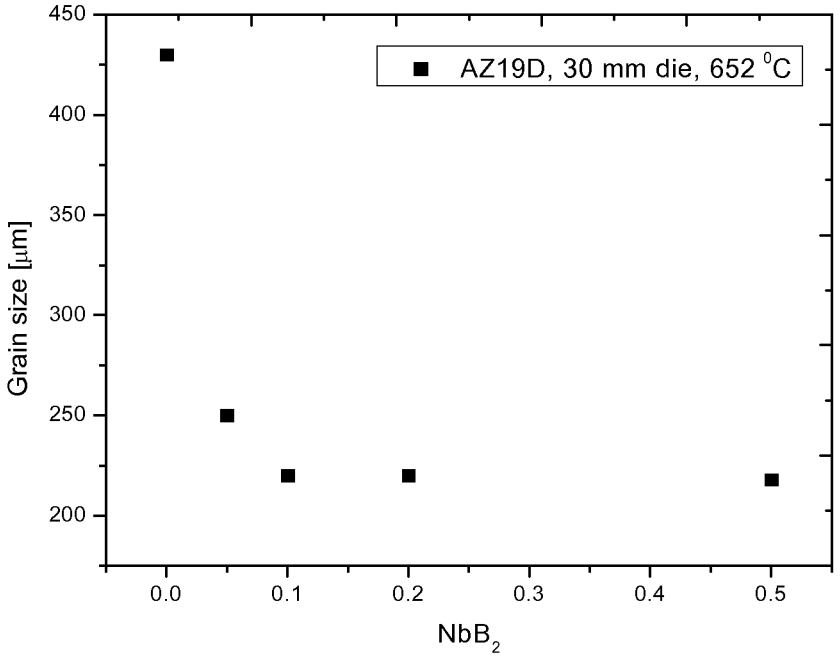
Figure 21:
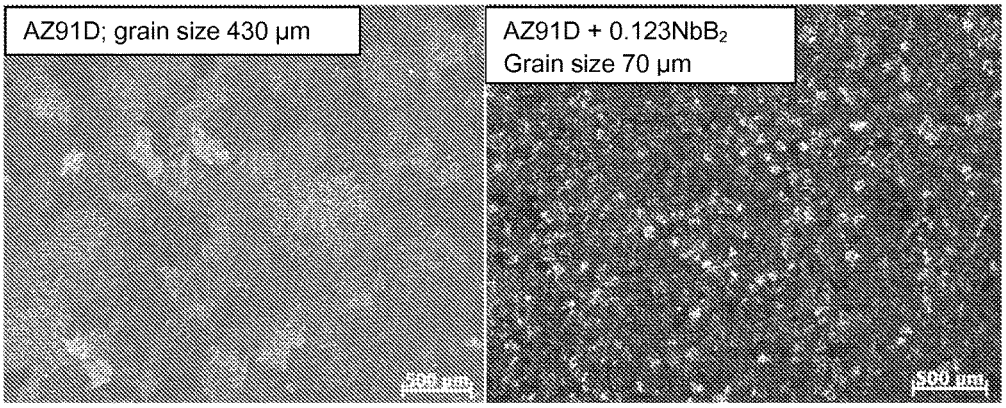
Figure 22:
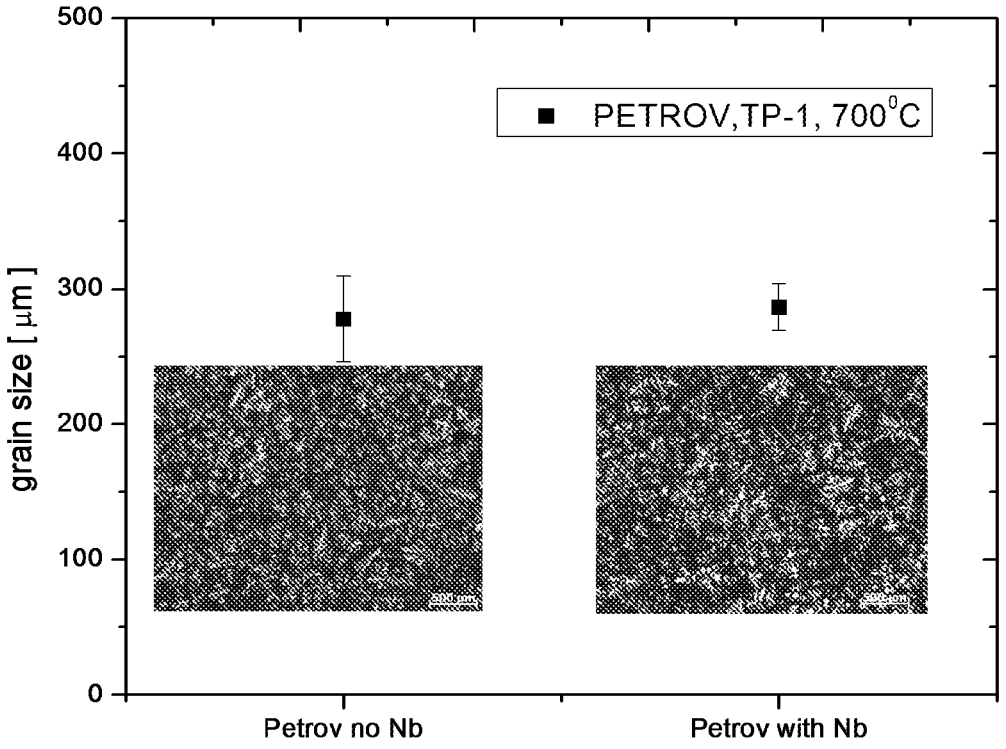
Figure 23:
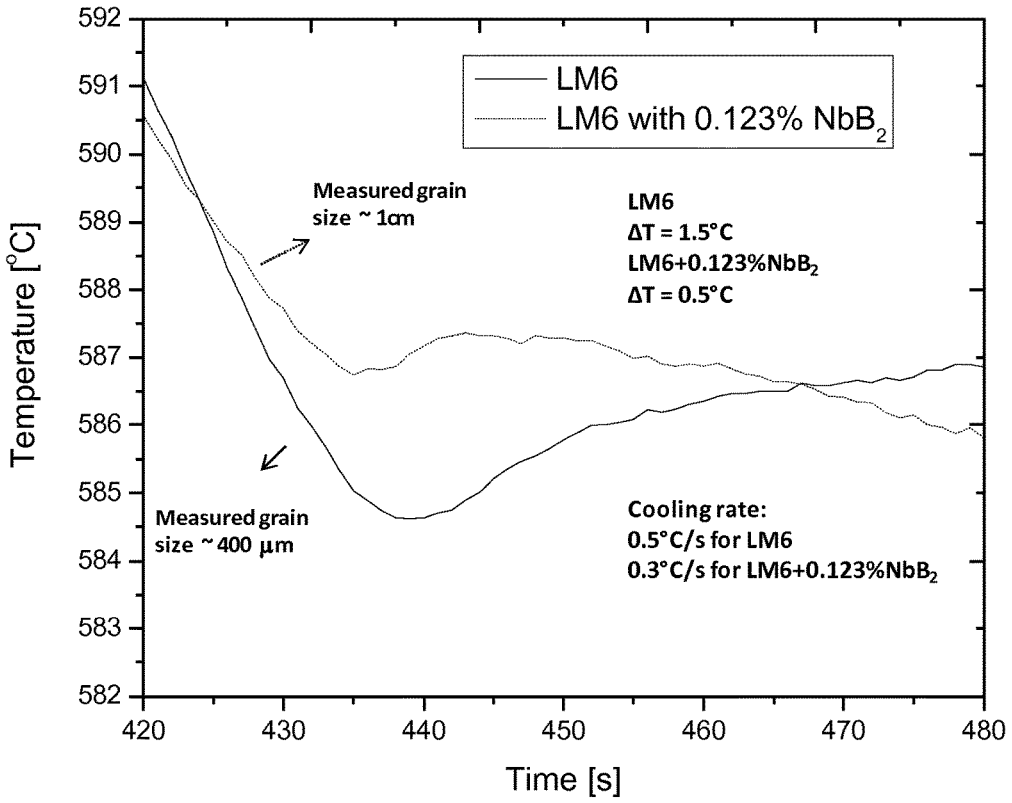
Figure 24:
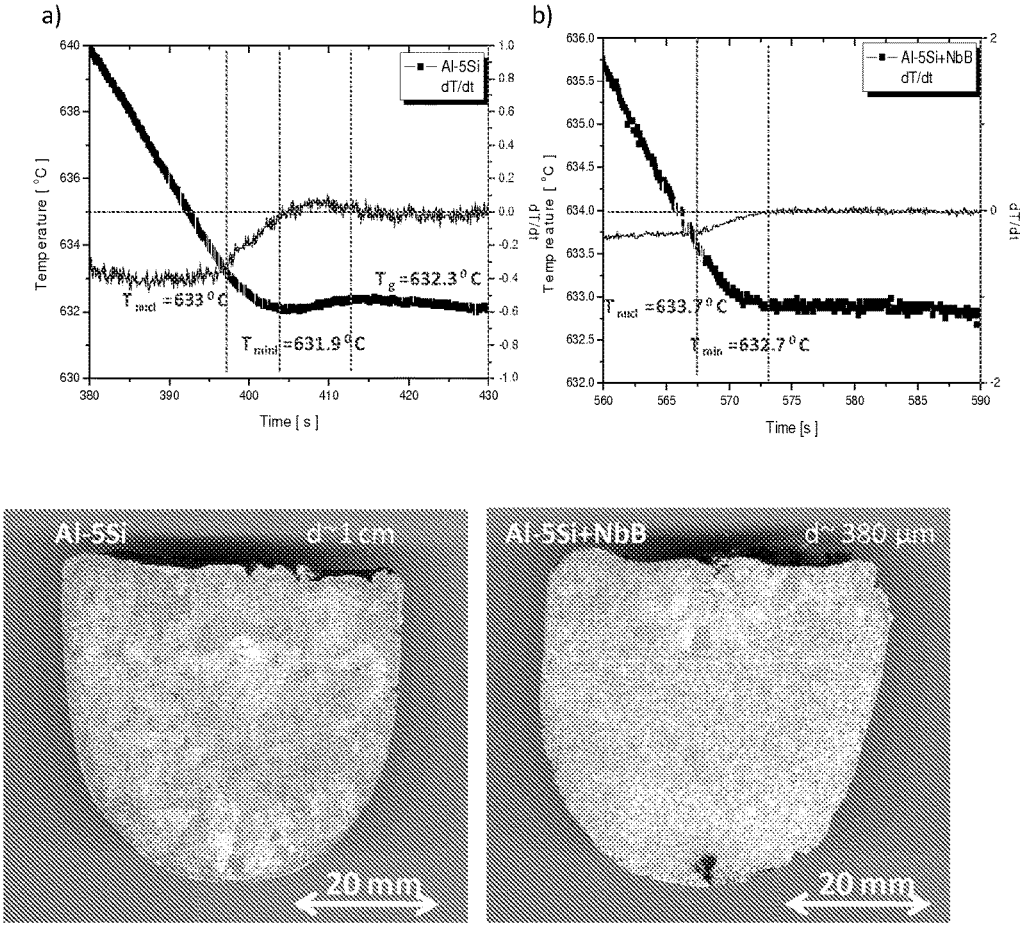
Figure 25:
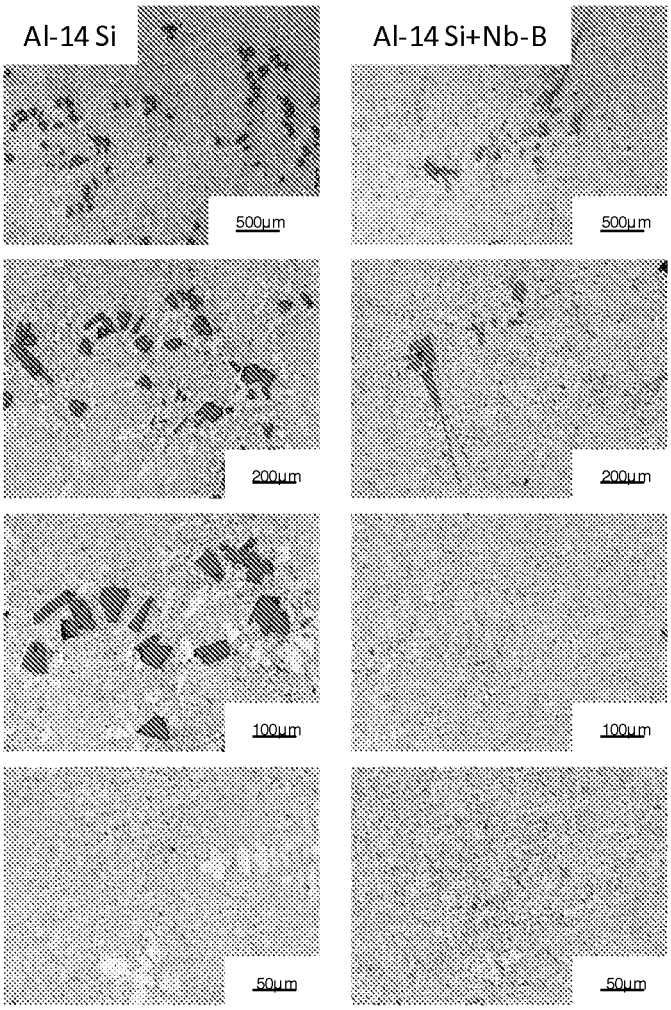
Figure 26:
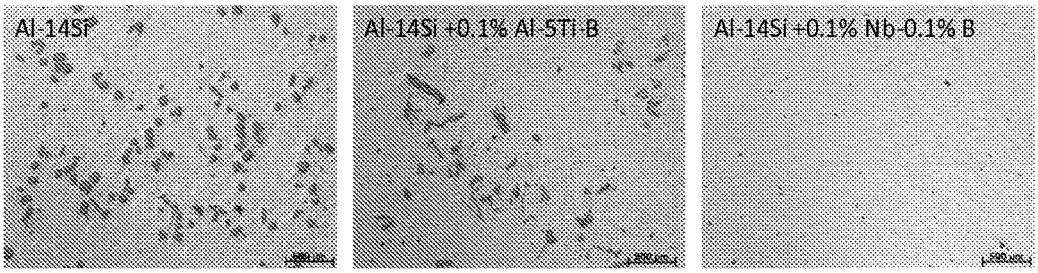
Figure 27:
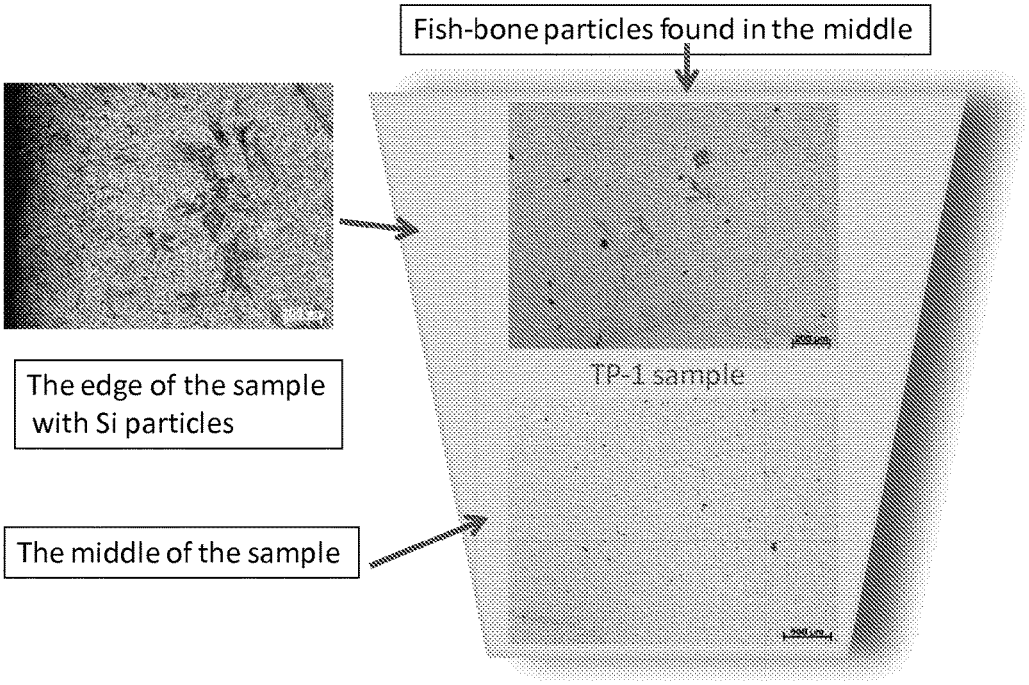
Figure 28:
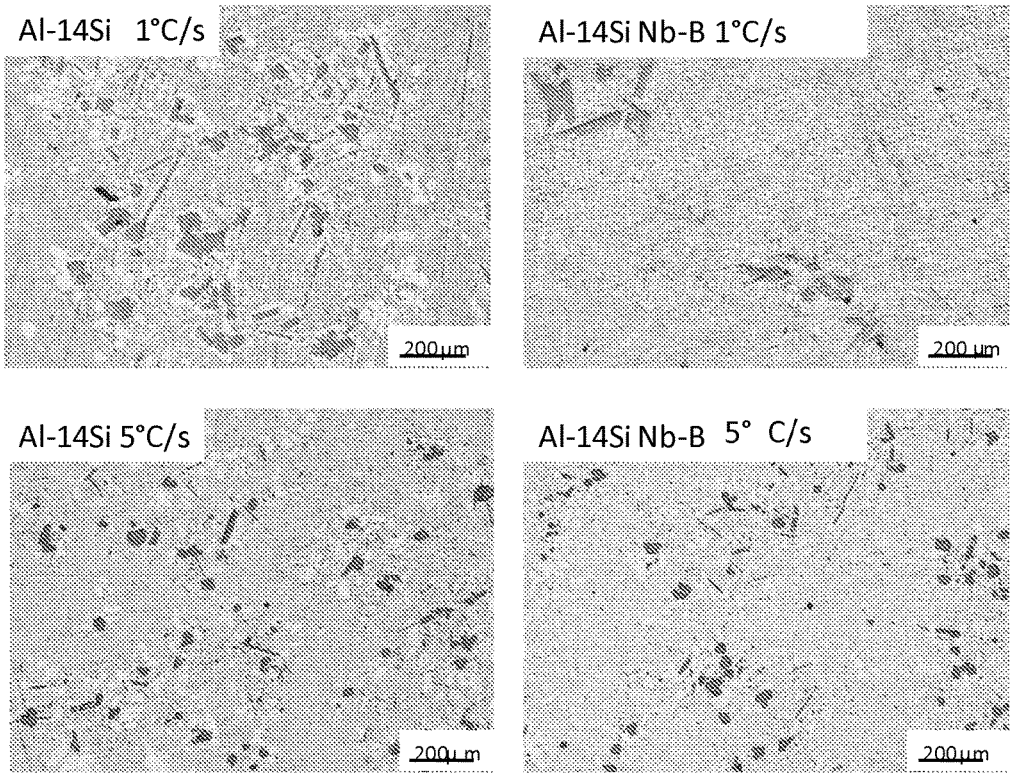
Figure 29:
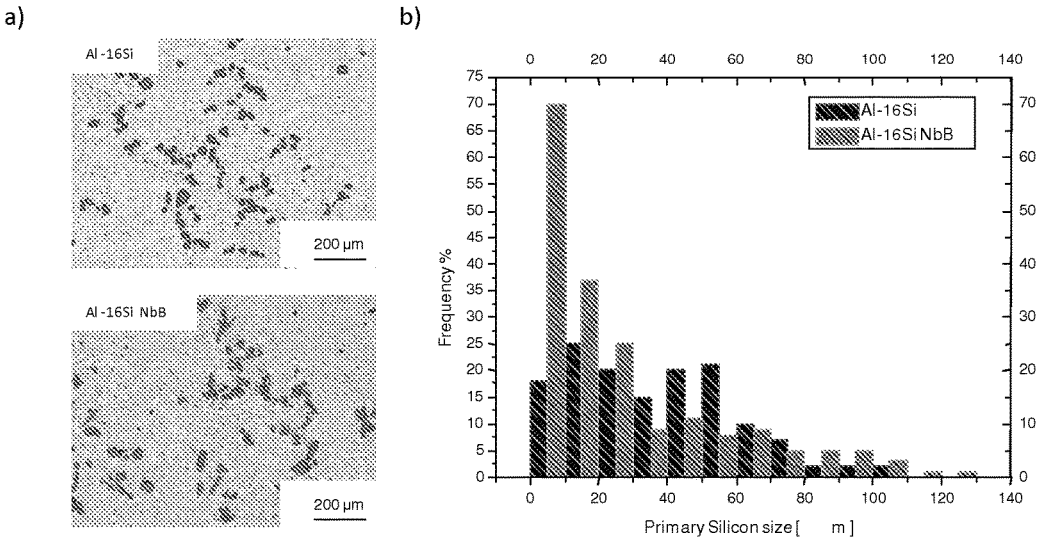
Figure 30:
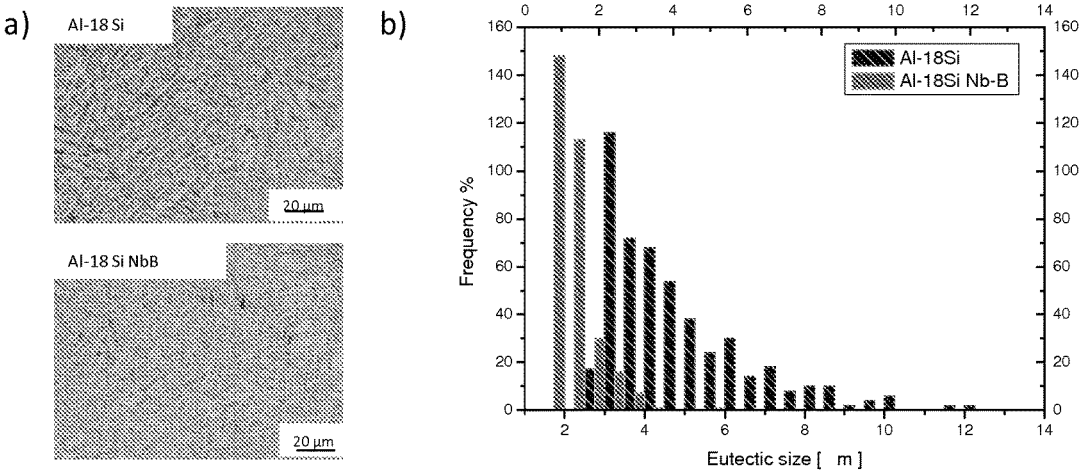
Figure 31:
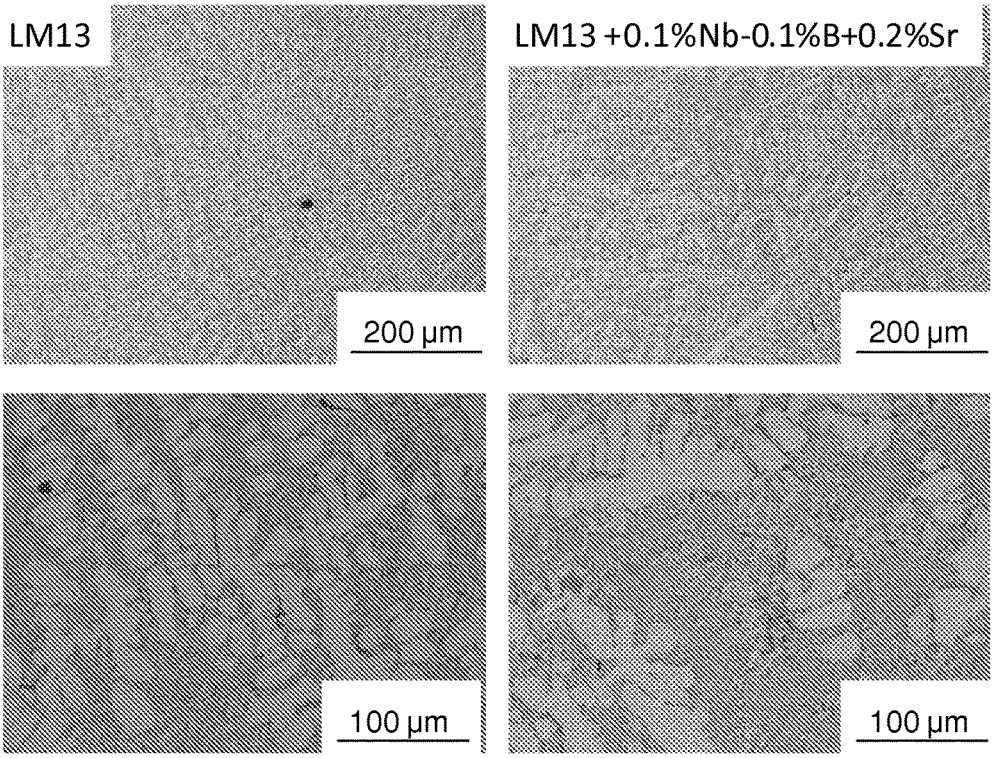
Figure 32:
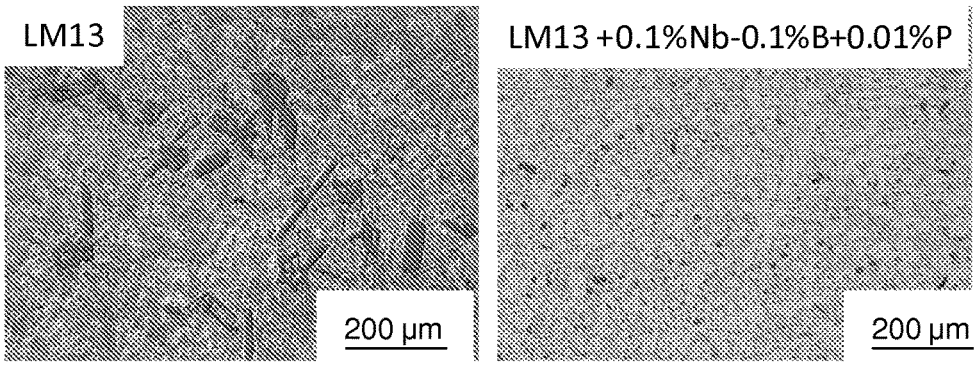
Figure 33:
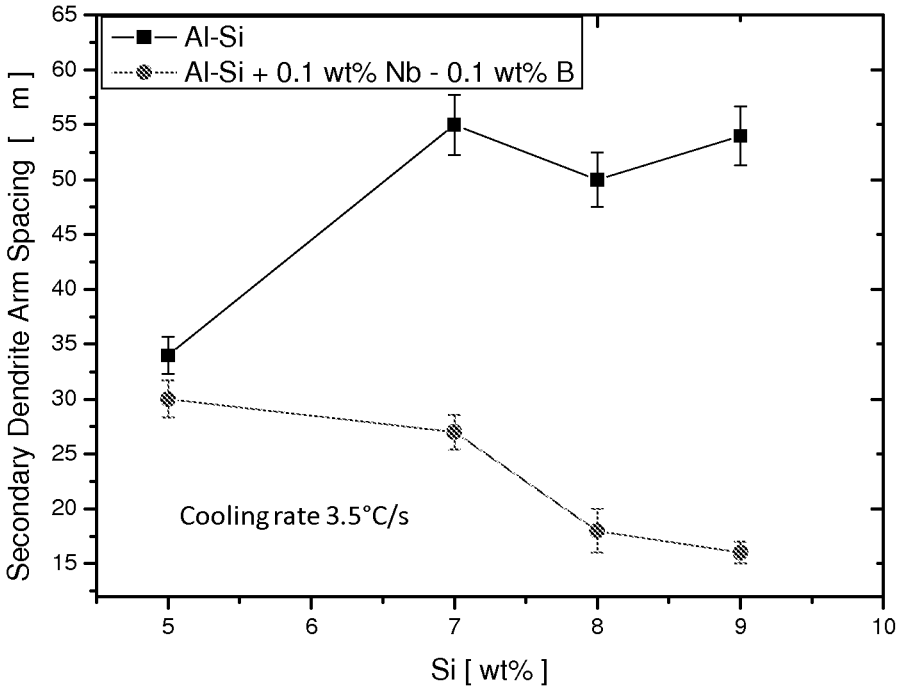
Figure 34:
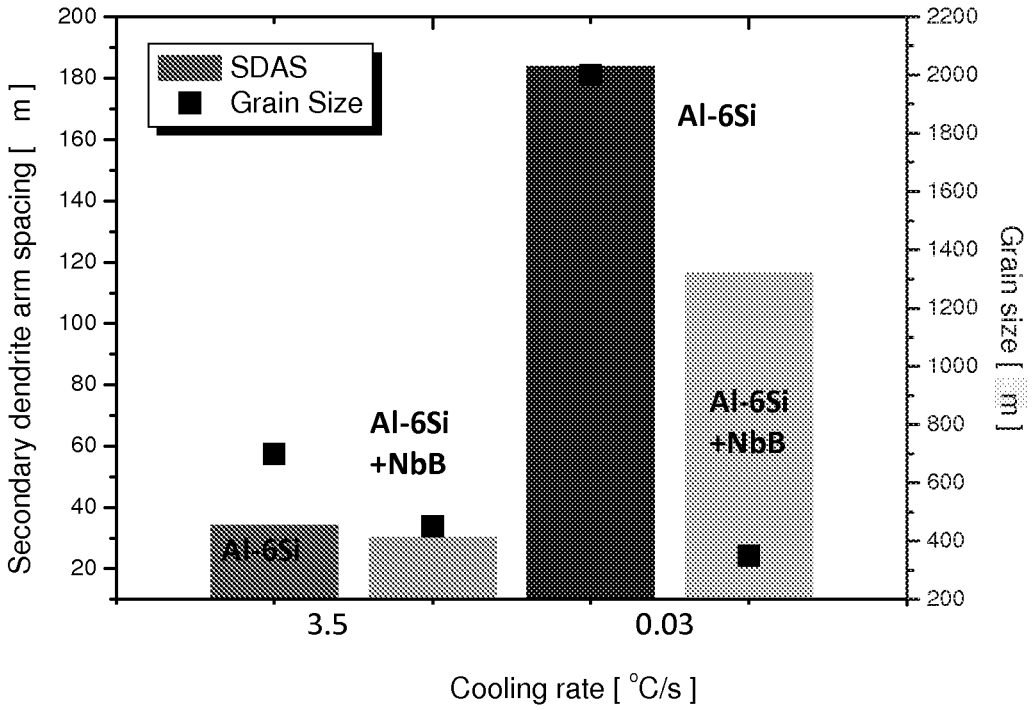
Figure 35:
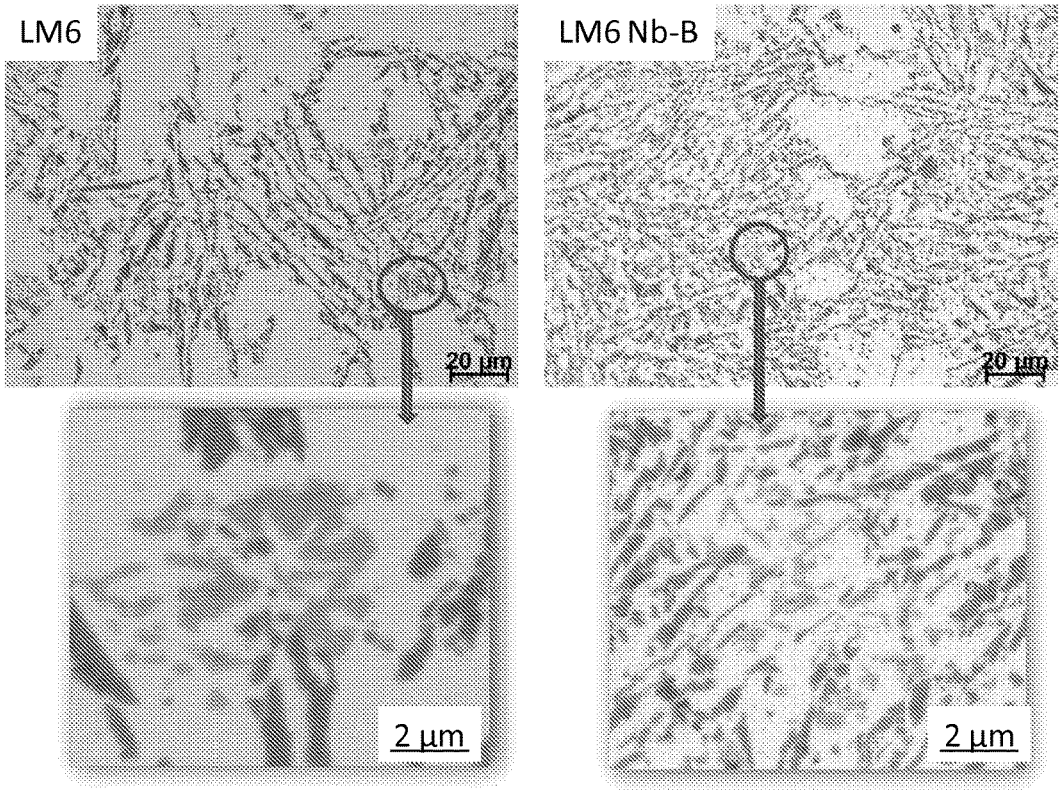
Figure 36:
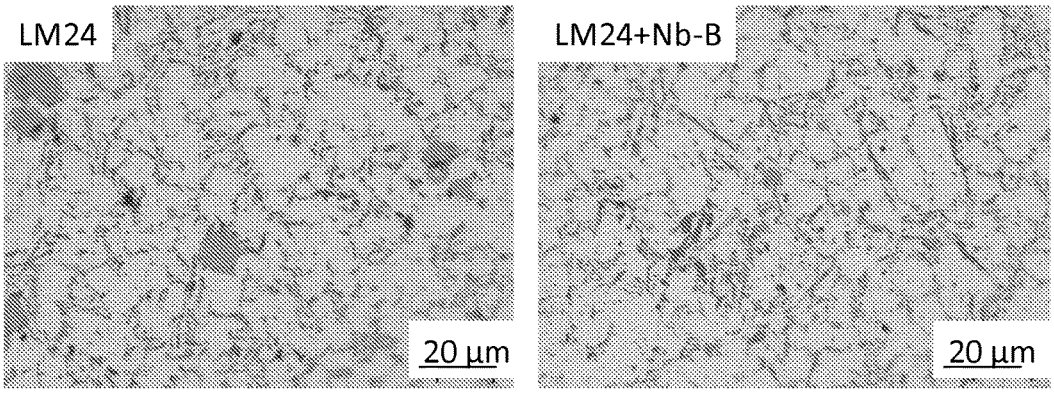
Figure 37:
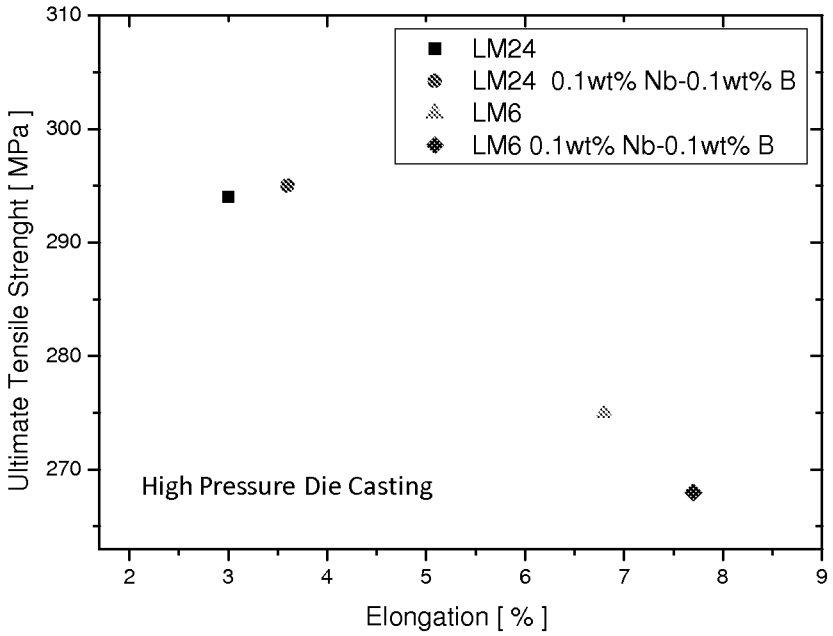
Figure 38:
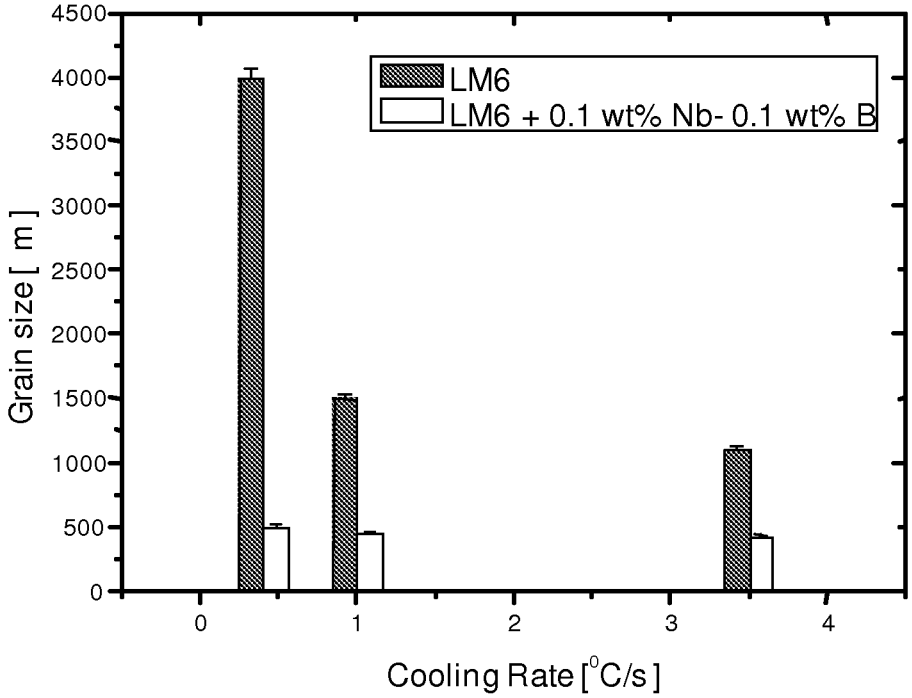
Figure 38:
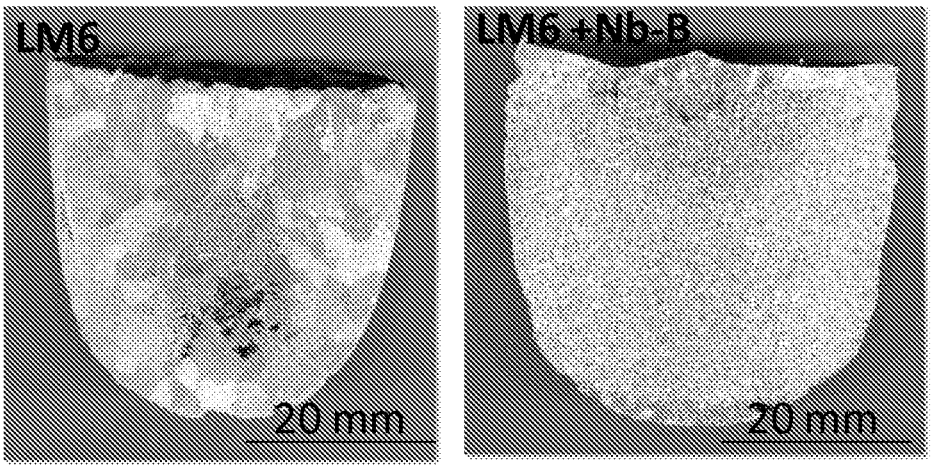
Figure 39:
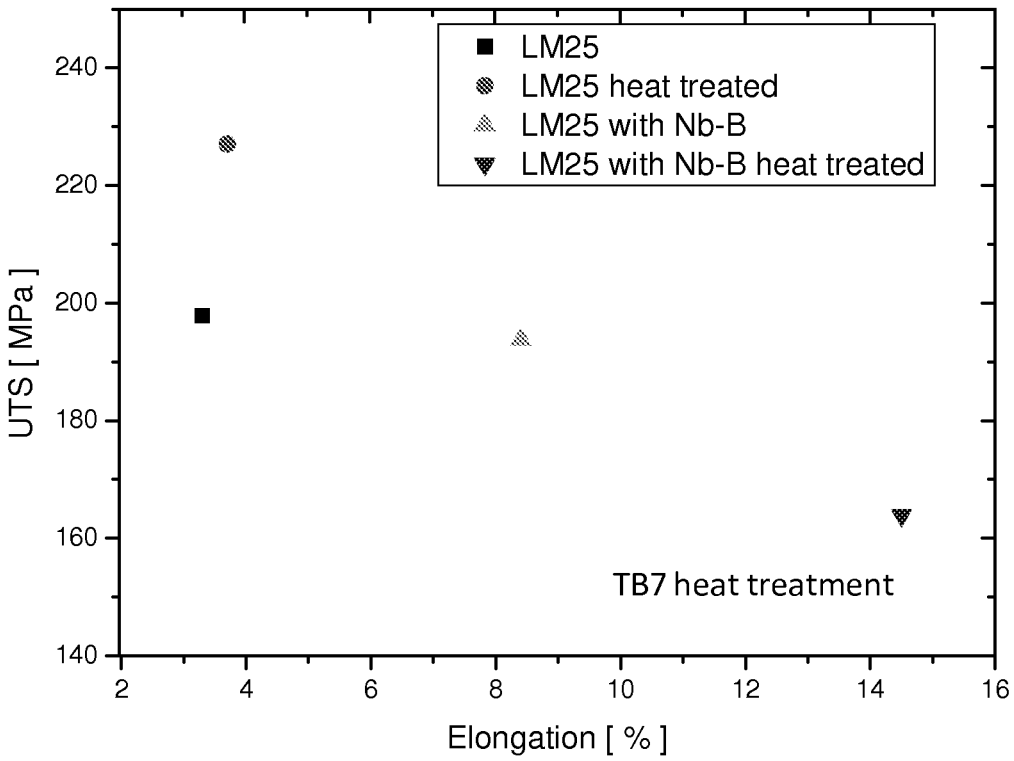
Figure 40:
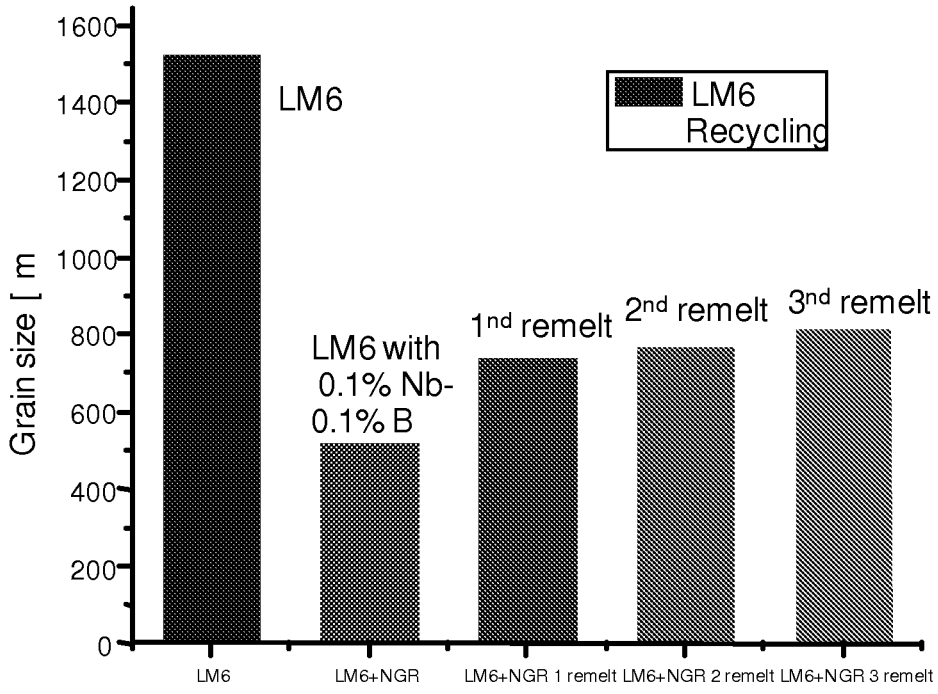
Figure 41:
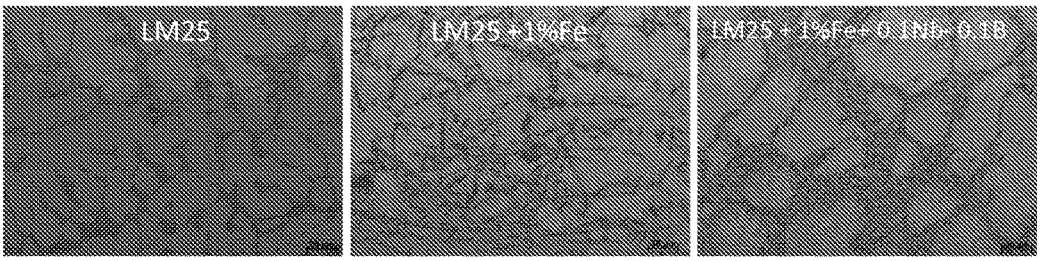
Figure 42:
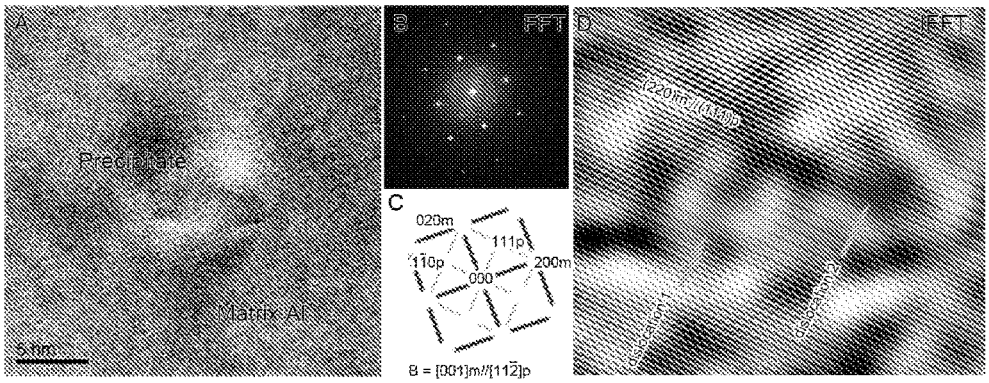
Figure 43:
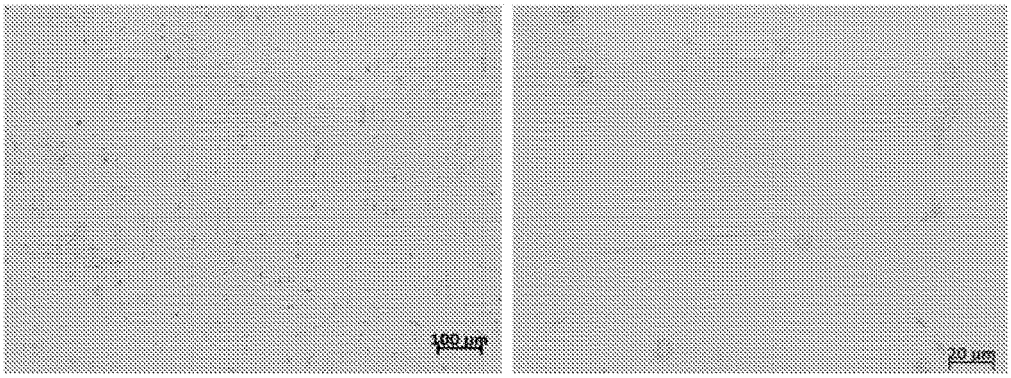

FIG. 19 depicts an LM6 alloy cast using a high pressure die cast process;

FIG. 20 is a graph showing grain size as a function of niobium diboride addition to an AZ91D alloy;

FIG. 21 shows micrographs of the structure of an AZ91D alloy cast without and with a niobium diboride grain refiner;

FIG. 22 shows the grain size and microstructures of a prior art alloy without and with additional niobium;

FIG. 23 is a graph of temperature as a function of time during the solidification of an LM6 alloy with and without a niobium diboride grain refiner;

FIG. 24 depicts the thermal analysis of Al-5Si alloy in the form of cooling curves of a) Al-5Si with undercooling of 0.4° C. b) Al-5Si with Nb—B addition with undercooling of ~0.1° C. The scanned images of macro-etched cross-sections of solidified samples for Al-5Si alloy without addition and with Nb—B addition are also shown. The grain size of Al-5Si is about 1 cm and when Nb—B is added it is decreased to 380 μm;

FIG. 25 shows optical micrographs of binary alloy Al-14Si with and without addition of Nb—B. Micrographs at various magnifications reveal the Si particle size and distribution. Large (~100 μm) sized primary Si are uniformly distributed in entire TP1 sample. When Nb—B is added, the primary silicon particle size is smaller (1-5 μm). A small fraction (<2%) of fish-bone type Si particles are also observed;

FIG. 26 shows typical microstructures of Al-14Si without addition, with 0.1 wt % Al-5Ti—B and 0.1 wt % Nb-0.1 wt % B additions;

FIG. 27 shows a schematic cross-section of the TP-1 sample of Al-14Si with addition of Nb—B and different microstructures;

FIG. 28 shows microstructures of a sample of Al-14Si without any addition and with Nb—B. Melt was cast into two types of moulds providing cooling rates of 1° C./s and 5° C./s;

FIG. 29 relates to an Al-16Si alloy cast in a mould with cooling rate of about 5° C./s and depicts a) microstructures showing primary silicon particles in Al—Si eutectic, and b) a histogram showing the particle distribution in Al-16Si without and with Nb—B addition;

FIG. 30 relates to an Al-18Si alloy and depicts a) microstructures of eutectic, and b) a histogram showing the eutectic size distribution in Al-18Si without and with Nb—B;

FIG. 31 includes microstructures of the LM13 alloy; LM13 with 0.1% Nb-0.1% B and with 0.1% Nb-0.1% B-0.02% Sr;

FIG. 32 includes microstructures of the LM13 alloy with and without Nb—B—P, addition of which resulted in fine grain structure for both primary Al and primary Si;

FIG. 33 is a graph showing the influence of Nb—B on the size of secondary dendrite arm spacing for Al—Si binary alloys;

FIG. 34 is a graph showing secondary arms spacing and grain size as a function of cooling rate for Al-6Si without any addition and with Nb—B (the secondary arm spacing decreases as the cooling rate increases);

FIG. 35 depicts microstructures of Fe phases in LM6 without and with Nb—B addition;

FIG. 36 depicts microstructures of high pressure die cast LM24 alloy without and with Nb—B addition;

FIG. 37 is a graph showing ultimate tensile strength versus elongation for LM6 & LM24 alloys processed using high Pressure Die Casting method;

FIG. 38 includes (a) a graph showing grain size as a function of cooling rate for LM6 with and without Nb—B addition and (b) pictures of macro-etched samples;

FIG. 39 is a graph of tensile strength as a function of elongation for LM25 without and with Nb—B addition, with heat treatment and without;

FIG. 40 is a graph depicting recycling of LM6 with the addition of 0.1 wt % Nb-0.1 wt % B;

FIG. 41 shows microstructures of LM25 alloy enriched with 1% Fe and 1% Fe/0.1 wt % Nb/0.1 wt % B;

FIG. 42 shows a Transmission Electron Microscopy analysis of particle/matrix interface. A good lattice match (<1%) between particle (p) and Al matrix (m). Coherent interface with dislocations observed; and FIG. 43 shows the microstructure of master alloy with the starting composition of Al-2Nb—B showing Nb based particles.

EXAMPLES

Example 1—Niobium Diboride as a Grain Refiner for LM6 Alloy

Figure 1:
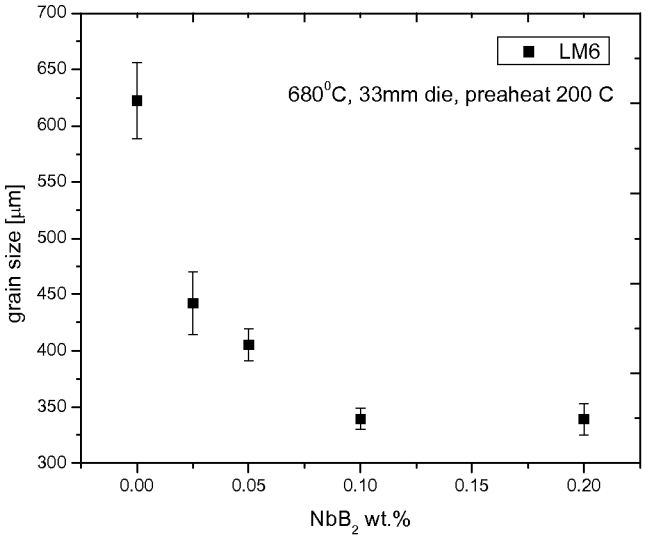

We have introduced $NbB_2$ phase (pre-synthesized in the form of Al-5 wt % of (Nb:2B molar ratio) into LM6 alloy (an aluminium alloy comprising the following elements at the following weight-percents: Si=10-13%; Fe=0.6%; Mn=0.5%; Ni=0.1%; Mg=0.3%; Zn=0.1%; and Ti=0.1%). As shown in the Table 1 below and in FIG. 1, grain size decreases as the Nb and B concentration increases, confirming that $NbB_2$ and/or $Al_3Nb$ enhances the heterogeneous nuclei in the melt.

TABLE 1

| wt % $NbB_2$ (based on starting composition) | Grain size |
|---|---|
| 0 | 622 |
| 0.025 | 442 |
| 0.05 | 405 |
| 0.1 | 339 |
| 0.2 | 340 |

Figure 2:
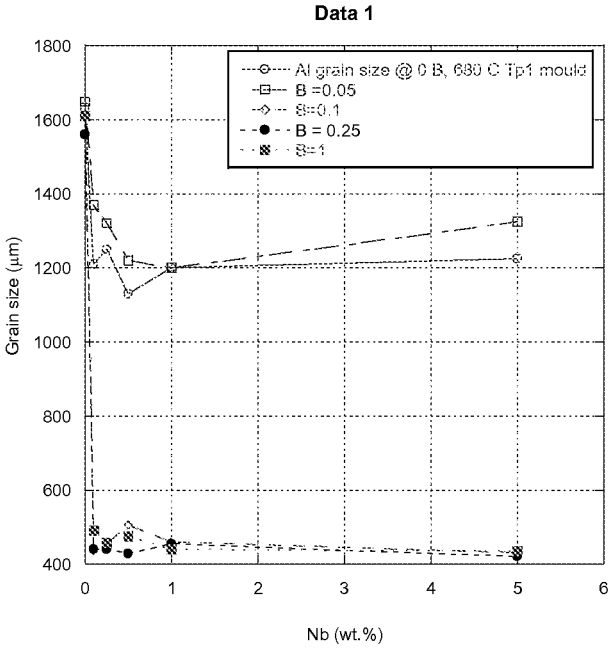
FIG. 2 is a graph showing grain size as a function of addition of niobium and boron for commercially pure aluminium.

Example 2—Niobium Diboride as a Grain Refiner for Commercially Pure Aluminium FIG. 2 shows the grain size of an aluminium alloy procured from Norton Aluminium Ltd. and consisting of impurities of Si-0.02; Fe=0.07; Mn=0.001; Zn=0.02; Ti=0.006; Ni=0.001 (all amounts in wt %) with various amounts of Nb and B addition. It can be seen from the Figure that combination of Nb and B addition is highly effective.

Figure 3:
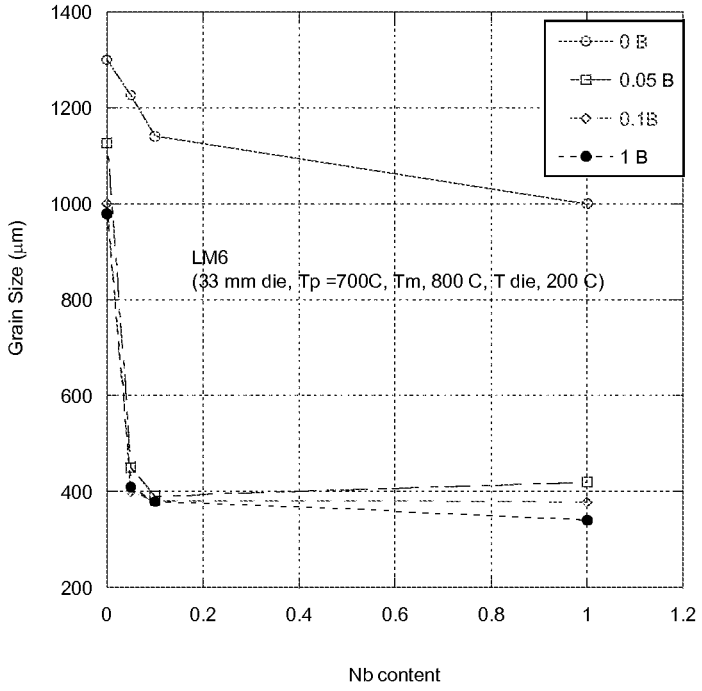
FIG. 3 is a graph showing grain size as a function of addition of niobium and boron for an LM6 alloy.

Similar results are obtained for Al—Si casting alloy (LM6) as shown in FIG. 3.

Example 3: Grain Refinement in Al—Si Binary Alloys

Alloys shown in Table 2 below were melted in an electric furnace at the temperature range 750-800° C. and held for 2 hours. An equal amount of Nb powder was mixed with boron in the form of $KBF_4$ powder. The reaction between $KBF_4$ and Al is exothermic and the local temperatures can be in excess of 1500 C for a short period of time. Approximately 0.1 wt % Nb and 0.1 wt % B was added to the melt of the alloys shown in Table 2. Experiments were also conducted with a wide range (0.1 to 5 wt %) of Nb and B levels, which corresponds to 0.12 wt % to 6.1 wt % of $NbB_2$. The standard test procedure, commonly known as TP1 mould, was used to cast with and without grain refiner addition. TP1 mould offers the cooling rate of 3.5K/sec, which is similar to that of large industrial casting conditions. For comparative purpose experiments with Al-5Ti—B grain refiner addition were carried out. Chemical electro-polishing ($HClO_4$+$CH_3COOH$) and Baker's anodizing were used to reveal grain boundaries. A Zeiss polarized optical microscope with an Axio 4.3 image analysis system was used to measure the grain size using the linear intercept method. The macro-etching was performed with Keller's solution to have a visual comparison of the grain size.

TABLE 2

| | Alloys | | | | | | | | |
|---|---|---|---|---|---|---|---|---|---|
| Composition | Si | Mg | Fe | Mn | Ni | Zn | Cu | Ti | Al |
| Commercial pure Al | 0.02 | — | 0.07 | 0.001 | 0.001 | 0.002 | — | 0.006 | 99.5% |
| Al—1Si | 1 ± 0.2 | — | <0.07 | <0.001 | <0.001 | <0.002 | — | <0.006 | remaining |
| Al—2Si | 2 ± 0.2 | — | <0.07 | <0.001 | <0.001 | <0.002 | — | <0.006 | remaining |
| Al—4Si | 4 ± 0.2 | — | <0.07 | <0.001 | <0.001 | <0.002 | — | <0.006 | remaining |
| Al—6Si | 6 ± 0.2 | — | <0.07 | <0.001 | <0.001 | <0.002 | — | <0.006 | remaining |
| Al—7Si | 7 ± 0.2 | — | <0.07 | <0.001 | <0.001 | <0.002 | — | <0.006 | remaining |
| Al—8Si | 8 ± 0.2 | — | <0.07 | <0.001 | <0.001 | <0.002 | — | <0.006 | remaining |

Results

Figure 4:
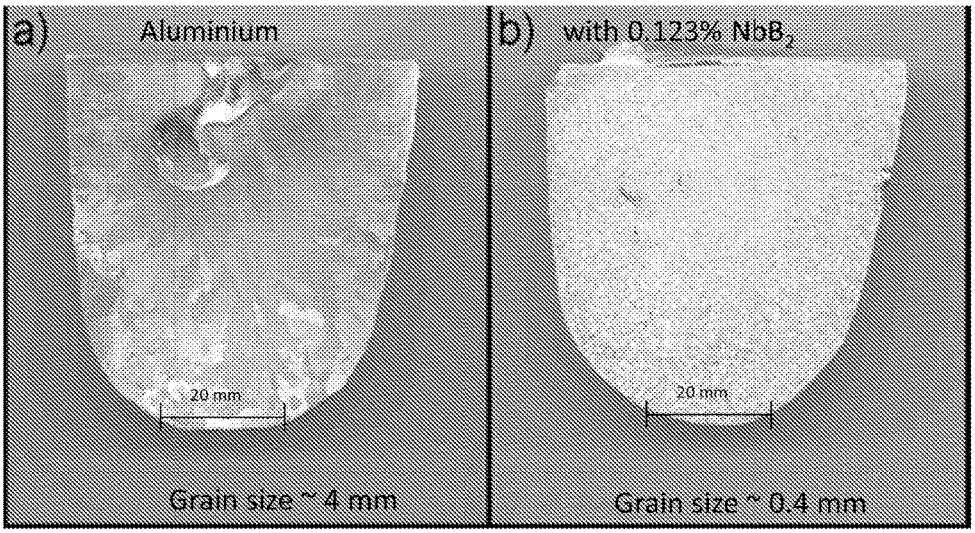
FIG. 4 shows photographs of a cross-section of commercially pure aluminium without and then with niobium and boron as a grain refiner.

The effect of the addition of 0.12 wt % niobium diboride to commercial pure aluminium is shown in FIG. 4. The grain size is observed to reduce significantly with the addition of Nb-based chemicals. Fine grain structure brings several benefits (e.g, reduced chemical segregation, reduced porosity, absence of hot tearing) when large sized billets are manufactured.

FIG. 5 shows the surface of macro-etched TP-1 test mould specimens produced from commercially pure aluminium, revealing grain size for aluminium (a) without and (b) with niobium diboride addition. FIG. 5(*c*) shows the measured grain size as a function of pouring temperature for Al alone and Al combined with niobium diboride.

For Al—Si casting alloys, it is known that the Al-5Ti—B master-alloy is not an efficient grain refiner and can even have an adverse effect. Our series of experiments in Al—Si binary alloys shows (see FIG. 6) that the niobium diboride grain refiner works better than Al-5Ti—B when Si content is >5 wt %.

Example 4: Grain Refinement in Commercial Casting Alloys

Table 3 shows list of commercial casting alloys that are commonly used for casting large structures (all amounts in wt %). All these alloys were melted between 750-800° C. 0.1 wt % Nb and 0.1 wt % of boron in the form of $KBF_4$ were added to the melt. A TP1 mould (cooling rate of 3.5K/sec) was used. For LM25, in addition to TP1 mould two other types of moulds (0.7K/s and 0.0035K/s) were used. These low cooling rates were used to simulate sand casting conditions, where the cooling rate can be as low as 0.1K/s.

TABLE 3

| | Alloy | | | | | | | | |
|---|---|---|---|---|---|---|---|---|---|
| | Si | Mg | Fe | Mn | Ni | Zn | Cu | Ti | Al |
| LM6 | 10-11 | 0.3 | 0.6 | 0.5 | 0.1 | 0.1 | 0.01 | 0.1 | remaining |
| LM24 | 8.54 | 0.13 | 1.2 | 0.19 | 0.04 | 1.36 | 3.37 | 0.04 | remaining |
| LM25 | 6-8 | 0.3 | 0.5 | 0.005 | — | 0.003 | 0.003 | 0.11 | remaining |

Experiments with LM25 casting alloy confirms that addition of niobium diboride decreases the grain size more effectively than that of TiB as shown in FIG. 7. The cooling rate was 3.5K per second, and this was the cooling rate for all Examples as they all used the same TP1 mould.

Experiments with LM24 casting alloy confirms that addition of niobium diboride decreases the grain size more effectively than that of Al—Ti—B as shown in FIG. 8. It can be seen that this effect is apparent at a range of temperatures, which is important because the usual industrial practice is to pour molten alloy at least 40-50° C. above the liquidus temperature.

Experiments with LM6 casting alloy confirms that addition of niobium diboride decrease the grain size more effectively than that of Al—Ti—B as shown in FIG. 9.

Influence of Nb and B on Grain Refinement in LM6 Alloy

In the literature, it is claimed that for Al—Si alloys, addition of boron, instead of Al—Ti—B addition refines the grain size. To verify this, we have added boron (in the form of $KBF_4$), niobium, Al-5Ti-1B and a combination of niobium and boron (in the form of Nb—$KBF_4$). As can be seen in FIG. 10, neither Nb nor B alone refines grain size. Only the combination of Nb—B refines the grain size effectively.

Mechanical Properties:

To produce tensile bars, cylindrical rod shaped (13 mm diameter and 120 mm length) LM6 alloy samples were cast with steel mould and machined the tensile bar specimens with dimensions specified by ASTM standards. The exact dimensions of the tensile test specimens are 6.4 gauge diameter, 25 mm in gauge length and 12 mm in diameter of grip section. The tensile property testing was carried out using a universal materials testing machine (Instron® 5569) at a cross head speed of 2 mm/minute (strain rate: $1.33\times10^{-3}$ $s^{-1}$). It is observed that the non-refined LM6 has an ultimate tensile strength (UTS) of 181 MPa, but that after grain refinement the UTS is improved by 20% to 225 MPa. Furthermore, the elongation has improved in LM6 with niobium diboride addition from 3% to 4.6%. The results are shown in FIG. 11.

Effect of Cooling Rate

FIG. 12 (*a*) shows the average grain size as a function of cooling rate. For LM25, the grain size significantly increases at lower cooling rates (sand casting mould cooling rate). Fine grain structure has been observed for Nb—B added alloy, which re-confirms its grain refining efficiency.

FIG. 12 (*b*) shows photographs of an LM6 alloy specimens formed with and without a niobium diboride grain refiner to demonstrate the effect cooling rates have on grain size In addition to primary Al grain size, fine Al—Si eutectic structure is also obtained at wide range of cooling rates—see FIG. 12 (*c*). This fine eutectic structure and reduced porosity improves the ductility of the alloy.

Porosity

An example of a casting defect is the porosity of a solidified alloy. FIG. 13 shows the comparison of porosity area fraction for three different casting conditions. It can be seen that Al—Nb—B master alloy addition reduces porosity significantly.

Example 5: Grain Refinement for Hyper-Eutectic Alloys

With an aim to investigate the effect of addition of Nb—B we have initially produced Al-14% Si alloy ingot and confirmed the uniformity of Si concentration across the block by sampling at various places in a master block using a foundry master. This alloy is melted at 750 C and 0.1 wt % niobium and 0.1 wt % boron (corresponding to 0.123 wt % $NbB_2$) were added to the melt before casting with TP1 mould (3.5K/s) and steel mould (1K/s).

Results

FIG. 14 shows the microstructure of Al-14Si with and without the addition of $NbB_2$. An extremely fine primary Si phase is observed. In addition, a fine eutectic needle structure is observed. It is important to note that no other processing methods are known to result in such fine grain structure.

Example 6: Method to Produce Al—$NbB_2$ Master Alloy

We have developed a practical method by which the newly discovered novel grain refiner with chemical combination of Nb and B can be added to the Al—Si based melt in simplistic way. In this method we first produce Al—Nb—B master alloy and we then demonstrate that by simply adding a small piece of this master alloy to the melt of Al—Si based alloy can result fine grain structure in solidified metal.

Addition of grain refiner in the form of master alloy is a common practice in the industry. It avoids use of corrosive $KBF_4$ salt in the casting process. Instead of salt addition, we show that one can add the niobium diboride grain refiner in the form of a small metal piece of Al—Nb—B master alloy to the Al—Si based liquid alloys to obtain a fine grain size. Addition of concentrated Al—Nb—B alloy ensures the uniform dispersion of $NbB_2$ into the aluminium melt.

The general formula for the master alloy is Al-x wt. % Nb-y wt. % B. The range for x is 0.05 to 10 and the range for y is 0.01 to 5. Three examples are provided here:

Example 6A: Processing of Al-4.05Nb-0.09B (Equivalent to Al-5 wt % of (Nb:2B Molar Ratio))

Commercial pure Al ingot was melted in an electric furnace at the temperature range 800-850° C. and held for 2 hours. 5 wt % $NbB_2$ (mixture of Nb and $KBF_4$) was added to the melt in order to form a $NbB_2$ phase. It is important to note that $Al_3Nb$ phase inclusions may also form. Reaction between $KBF_4$ and Al is exothermic and the local temperatures can be in excess of 1500° C. for a short period of time and is believed that the high temperatures promote Nb dissolution into Al. The melt was stirred with a non-reactive ceramic rod for about 2 minutes every 15 minutes. Dross on the surface of the melt was scooped and the liquid metal was cast into a cylindrical mould. The cast metal is referred to as Al—Nb—B grain refiner master alloy. The microstructure of Al—Nb—B is shown in FIG. 15, which reveals fine inclusions and finely structured Nb based particles uniformly distributed in Al matrix. TEM study suggests the interface between Al and inclusion is highly coherent, suggesting that they may be enhancing heterogeneous Al nuclei formation.

Example 6B: Addition of Al-5Nb-1B Master Alloy to Commercial Pure Aluminium

Commercial pure Al was melted in an electric furnace at the temperature range 750-800° C. and held for 2 hours. A small piece of Al-5 wt % $NbB_2$ master alloy (equivalent to 0.1 wt % $NbB_2$ w.r.t weight of Al) was added to the melt. 15 minutes later, the melt was stirred for about 2 minutes and cast into a TP1 mould. The samples were polished and anodized to reveal grain boundaries. FIG. 16 shows the grain size of commercial pure Al added with small amount of Al—Nb—B grain refiner master alloy addition. It can be seen that fine grain structure can be also obtained with this practical route. The microstrucural features look similar to that of FIG. 4.

Example 6C: Addition of Al-5Nb-1B Master Alloy to Commercial Al—Si Alloy (LM25)

LM25 alloy was melted in an electric furnace at the temperature range 750-800° C. and held for 2 hours. A small piece of Al-5 wt % $NbB_2$ master alloy (equivalent to 0.1 wt % $NbB_2$ w.r.t weight of LM25) was added to the melt. 15 minutes later, the melt was stirred for about 2 minutes and cast into a TP1 mould. FIG. 17 shows the grain size of LM25 added with Al—Nb—B master alloy addition and is compared without addition. It can be seen that the refined grain structure can be obtained through the addition of Al—Nb—B mater alloy.

Example 7: Fading Study

Nucleant phase particles in an aluminium liquid melt can form agglomerates and this agglomeration behaviour increases with time. As a result, the grain refinement efficiency deteriorates with time. Hence, from the view point of industrial application, where liquid remains at high temperatures for at least 30-60 minutes, the fading study is quite important.

Experiment: about 2 Kg of LM6 alloy melt was prepared in an electric resistance furnace. A test sample was cast using a TP1 mould. Nb/B was added to the melt and stirred. Samples at various time intervals were cast into the TP1 mould. Prior to casting, the melt was stirred gently with a ceramic rod. FIG. 18 shows the grain size as a function of time. Grain size is almost unaffected up to 1 h and then observed to increase slightly with time. It is important to note that, even after 3 h, the grain size is about 515 μm, which is significantly lower than the LM6 grain size.

Example 8: Tensile Properties of Grain Refined LM6 and LM24 Produced with High Pressure Die Casting The earlier examples employ gravity casting to produce LM6 alloys. However, industrial processes produce small alloy components using high pressure die casting (HPDC), which is a very high speed manufacturing process. LM24 alloy is a specially designed alloy for HPDC. In this study, both LM24 and LM6 alloys with and without addition of Nb/B were cast using an HPDC machine. Note that the cooling rate provided by HPDC is $>10^3$ K/s. Even at such high cooling rates, refinement of grain size is observed (see FIG. 19). Elongation has been improved from 6.8% to 7.7% for LM6 alloy and from 3% to 3.6% for LM24 alloy. If two materials have the same strength and hardness, the one which has higher ductility is more desirable for practical applications.

Example 9: $NbB_2$ Addition for Magnesium (AZ91D) Alloys

The Al-5 wt % $NbB_2$ master alloy synthesised in Example 6 above was added to AZ91D alloy in liquid and cast form. As shown in FIG. 20, the grain size for AZ91D alloy decreases as the $NbB_2$ concentration increases, confirming that $NbB_2$ enhances the heterogeneous nuclei in the Mg alloy melt. Without wishing to be constrained by theory, it is thought that the reason for the decreased grain size is primarily due to the matching between $NbB_2$ and Mg phase crystals. Both crystal structures are hexagonal and the lattice mismatch in the basal plane is 1.8%. It is known that the energy barrier for the formation of heterogeneous nuclei is negligible when their lattice mismatch is small (<5%).

Example 10: Grain Refinement in Mg Alloy

AZ91D alloy was melted in an electric furnace at 680° C. and held for 2 hours. $SF_6$+$N_2$ gas mixture was used to protect the melt from oxidation. Approximately 0.1 wt % Nb and 0.1 wt % B (about 0.123 wt % $NbB_2$) was added to the melt and stirred for 1 minute with an impeller. A steel cylindrical mould with 33 mm inner diameter was preheated to 200° C. and the melt containing $NbB_2$ was poured into the mould. For comparative purpose an experiment without any $NbB_2$ addition was also carried out. Both cast samples were polished and chemical etched. A Zeiss polarized optical microscope with an Axio 4.3 image analysis system was used to measure the grain size using the linear intercept method. Very fine grain structure was observed as shown in FIG. 21.

Example 11: Comparative Experiment

An alloy with the composition set out below was prepared with and without the addition of 0.15 wt % niobium. The alloy having 0.15 wt % Nb falls within the range of alloys disclosed in SU 519487 (Petrov). TP1 cast samples were produced at similar condition for both alloys. As can be seen in FIG. 22, the addition of niobium did not result in grain refinement, which is consistent with niobium diboride not being formed in the alloy disclosed in Petrov.

| Composition (wt %) | |
|---|---|
| Silicon | 10 |
| Copper | 3.5 |
| Magnesium | 0.4 |
| Manganese | 0.25 |
| Titanium | 0.2 |
| Zirconium | 0.2 |
| Boron | 0.025 |
| Molybdenum | 0.2 |
| Cadmium | 0.02 |
| Barium | 0.05 |
| Calcium | 0.05 |
| Sodium | 0.005 |

-continued

| Composition (wt %) | |
|---|---|
| Potassium | 0.025 |
| Aluminium | remainder |

Example 12: Measuring the Cooling Curve for an LM6 Alloy

LM6 alloy samples with and without 0.1 wt % Nb+0.1 wt % B (in the form of $KBF_4$) were placed in a pre-heated (800° C.) steel crucible (equivalent to 0.123 wt % $NbB_2$). The temperature of the sample as a function of time was monitored using K-type thermocouple (0.5 mm in diameter) and recorded by data acquisition software. The measured cooling curves are presented in FIG. 23. It can be seen that the cooling rate for pure LM6 liquid and LM6 with 0.1 wt. % Nb+0.1% B (equivalent to 0.123 wt % $NbB_2$) liquid are similar (about 0.5° C./s and 0.3° C./s, respectively). The undercooling for LM6 is measured to be 1.5° C., whereas the addition of 0.1 wt % Nb+0.1 wt % B dramatically decreased the undercooling (ΔT is about 0.5° C.). The decreased undercooling clearly demonstrates that the existence of Nb based inclusions in the Al—Si liquid metal can enhance the heterogeneous nucleation process and as a result reduce the grain size of castings from 1-2 cm to about 440 μm.

Example 13: Cooling Curves for Al-5 Si Alloy

The thermal analyses were conducted on the measured cooling curves for the Al-5 Si melt with and without addition of Nb—B (see FIG. 24). The measured undercooling is measured to be 0.4 and 0.1° C. for Al-5 Si alloys without and with Nb—B addition. The macro-etched surfaces of ingots that are produced as a result of cooling curve measurements are also shown. A big difference in grain size is achieved with the usage of Nb—B addition for very slow cooling rates of 0.04° C./s, similar to the sand casting process that is commonly used by industries to produce large cast structures for automotive applications.

Example 14: Addition of Nb—B to the Hypereutectic Al—Si Alloys

Al-14 Si near eutectic point was melted at 800° C. Melt with and without addition of 0.1 wt % Nb+0.1 wt % B were cast at 700° C. into the TP-1 mould that provides a cooling rate of 3.5° C./s.

From FIG. 25, it is noticeable that Al-14Si alloy with addition of Nb—B consists of a very few primary large silicon particles. There are different shapes: hopers (square shape) and fish-bone (long looking like a fish bone). Fish-bone shape primary silicon particles are observed at the edges of the sample (near the mould wall) whereas the hoper shapes are at the middle of the sample. For comparison addition of Ti—B grain refiner to Al-14 Si is shown in FIG. 26.

FIG. 27 presents the schematic cross-section of the TP-1 sample of Al-14 Si with Nb—B addition and the microstructural differences within the sample are shown in micrographs.

The cross-section of the TP-1 sample of Al-14Si revealed that the Si particles are bigger at the edge of the sample. However the most of the sample consists of fine Si particles and eutectic structure.

Two different moulds are used to achieve 1° C./s and 5° C./s cooling rates. FIG. 28 shows the difference in primary silicon size with increasing the cooling rate. The hopers like crystals are dispersed only near the wall where the higher cooling rate is and their area fraction is about 10% of the whole sample area. However in the middle of the sample the primary silicon particles grew as fishbone morphology.

A high cooling rate and a short solidification time can lead to the formation of a more refined microstructure. The primary silicon particles size is decreasing with a higher cooling rate for Al-14Si with Nb—B from 55 μm to 17 μm. In the case of Al-14Si without addition the change of the Si particles size is not significant. Particle size is decreased from 50 μm to 35 μm. Also change in the size of α-Al (white in contrast regions in FIG. 28) was noticeable, in alloys containing Nb—B the α-Al is much finer than in samples without addition.

FIG. 29 shows that the addition of Nb—B to Al-16Si decreases the primary silicon. Nb—B addition has not resulted in reducing the size of all Si particles. The sample has some big and very small particles when compared with Al-16Si without any addition The quantitative analysis was performed for eutectic size. It is clearly seen from FIG. 30, that the eutectic is much finer with addition of Nb—B. It can be assumed that the Nb—B is refining α-Al and primary silicon. The eutectic of α-Al and silicon is more fibrous and is not a coarse-like structure, as is commonly seen in Al-18Si without any addition.

Example 15: Effect of Nb—B Addition for LM13 Alloy (Al-13Si-0.8Cu) Along with Sr or P Additions (a) Sr addition: The alloy LM13 is used in production of pistons for automotive applications. The influence of Nb—B as well as Sr and P addition to LM13 are investigated. Eutectic Si size and morphology modification is a common practise for LM13 alloys to improve mechanical properties through promoting a structural refinement of the inherently brittle eutectic silicon phase. It is well known that additions of strontium to Al—Si alloys result in a transformation of the eutectic silicon morphology from coarse plate like structure to a well refined fibrous structure. The experiments were conducted to investigate the addition of Nb—B and Sr to the LM13 alloy. FIG. 31 demonstrates the morphological difference in macrostructures.

In LM6 with Nb—B+Sr addition the refining of α-Al is still taking place as well as modification of eutectic.

(b) P addition: Since the well known primary silicon refiner is phosphorus, a series of casting experiments were carried out to investigate the influence of Nb—B—P addition and the results are shown in FIG. 32. Finer aluminium grain structure is present even in the presence of P suggesting that, depending on alloys composition, Nb—B grain refiner could be used along with Sr or P additions (c) Ti rich alloys: Most of the commercially available Al—Si alloys consist of Ti levels of up to 0.2%. Since Ti is known to poison grain refinement effect in Al—Si alloys by the formation of Ti—Si, it is important to investigate the effect of Nb—B addition to the alloy that consists of higher Ti levels. LM25 and LM24 alloys shown in this study consist of 0.1 wt % Ti. In all these alloys addition of Nb—B is observed to refine the grain size significantly as described in the examples. In another experiment, LM25 alloy is enriched with Ti to the overall content of 0.2 wt %. It is experimentally confirmed that the grain refinement is observed when 0.1 wt % Nb+0.1 wt % B is added to the alloy.

Example 16: Effect of Nb—B on Secondary Dendrite Arm Spacing (SDAS) for Al—Si Binary Alloys Historically, the cooling rate has been proven to be one of the effective parameters to control the microstructure of as cast alloys. By increasing the cooling rate the secondary arm spacing of the alloys decreases and the strength of the alloy increases. Slow cooling rate in sand casting normally result in larger dendrite arm spacing and lower tensile strength. By reducing the grain size and dendrite arm spacing, one can improve the mechanical properties of the alloys. SDAS measurements suggest that Nb—B grain refiner has an effect on SDAS formation as shown in FIG. 33. The secondary dendrite arms spacing is observed to decrease with higher silicon additions in the grain refined samples.

FIG. 34 presents dependency between the cooling rate, the secondary arms spacing and grain size. SDAS is higher for samples cast at low cooling rates when compared to higher cooling rates.

Example 17: Effect on Intermetallics Size

The effect of Nb—B addition on itermetallics observed in LM6 and LM24 alloys is investigated. The iron phases in LM6 without and with Nb—B have mostly the Chinese script morphology, however, the size and dispersion of the particles is smaller (FIG. 35) when Nb—B is added to the melt. They are dispersed uniformly everywhere.

The cubic morphological intermetallics were found in the LM24 and LM6 samples processed with the high pressure die casting method (FIG. 36). The iron particles are smaller by 40% in LM24 with Nb—B due to smaller grain size and eutectic phases.

Example 18: Mechanical Properties of High Pressure Die Cast LM24 and LM6 Alloys

FIG. 37 shows the tensile test results for LM6 and LM24 without and with Nb—B addition. The diagram presents the average ultimate tensile strength of six samples and their corresponding elongation values are presented in this figure.

Example 19: Influence of Cooling Rate and Nb—B Addition on Grain Structure

The LM6 alloy was melted at 800° C., without and with Nb—B addition and cast into different moulds to achieve diverse cooling rates. FIG. 38 shows the grain sizes as a function of cooling rate. It can be seen that the grain refiner is less sensitive to different cooling rates. Even with a cooling rate as low as 0.03° C./s the grain sizes are still smaller when Nb—B is added. Cross sections of sample produced under such slow cooling are shown in the figure.

Example 20: Influence of Nb—B on Heat-Treatment of Al—Si Alloys

Most aluminium castings are used in the 'as cast' condition, but there are certain applications that require higher mechanical properties, or different properties from the as cast material. The heat treatment of aluminium castings is carried out to change the properties of the as cast alloys by subjecting the casting to a thermal cycle or series of thermal cycles. The experiments were carried out to compare the tensile properties of LM25 without any addition and with Nb—B. Also the heat treatment was performed on the tensile bars to analyse the heat treatment influence on the metal. The samples were melted at 800° C. and poured into the preheated cylindrical mould for tensile bars preparation. The LM25 was solution treated and stabilized for 5 h at 532° C. and then quenched in hot water followed by stabilizing treatment at 250° C. for 3 h (TB7). The diagram shown in FIG. 39 presents the maximum value of measured elongation as a function of the corresponding tensile stress for LM25 without addition and with Nb—B, heat treated and not heat treated.

As it is seen from diagram FIG. 39, the heat treatment of LM25 has improved its tensile strength. The addition of Nb—B improves the elongation and tensile strength of LM25. The heat treatment of LM25 with Nb—B improved significantly the elongation from 3.3-3.7% for LM25 without any addition to 14.7%.

Example 21: Recycling of the LM6 Alloy

Recycling of return process scraps is a general practice in aluminium foundries. 1 kg of LM6 melt was produced with 0.1 wt % Nb-0.1 wt % B addition. The sample was cast into the cylindrical mould preheated to 200° C. with the pouring temperature of 680° C. The sample then was cut and the microstructure analyses were done. The rest of the metal was melted again without any additional Nb—B. The procedure was repeated 4 times. FIG. 40 shows the grain sizes versus different recycling steps.

Similar experiment is repeated to LM25 alloy and confirmed to retain fine grain structure even after recycling 3 times.

The grain sizes are smaller after first casting then slightly increased after first re-melt. The second and third re-melt have still positive grain refinement sign. The nucleation sites are still active in the melt which will be beneficial for the recycling of the alloys after Nb—B grain refiner addition. It is possible to get smaller grains with additional levels of Nb and B to the melt and this study will be important from industrial application view point.

Example 22: Fe Impurity Tolerance in LM25 Alloy

Iron content in scrap alloy is generally higher than the specified iron levels for most of the commercial alloy compositions. Increased concentration of Fe results in larger needle shaped AlFeSi phase particles. These large sized needles are detrimental to mechanical properties in particular to the ductility. The effect of Nb—B addition to the LM25 enriched with 1 wt % Fe has been investigated and it is identified that the AlFeSi needle particle size is significantly reduced when Nb—B is added as shown in FIG. 41.

Example 23: Transmission Electron Microscopy Study of Al-5 wt % $NbB_2$ Master Alloy TEM analyses were done for the Al-5$NbB_2$ to investigate the phase contrast between the Al and $NbB_2$ or $Al_3Nb$. Phase contrast results whenever electrons of different phase are allowed to pass through the objective aperture. Since most electron scattering mechanisms involve a phase change then that some sort of phase contrast is presents every image. The most useful type of phase contrast image is formed when more diffracted beams are used to form the image. Selecting several beams allows a structure image, often called as a high-resolution electron microscope (HREM) image, to be formed. The many lattice fringes intersect and give a pattern of bright spots corresponding to atom columns as it seen at the FIG. 42. It can be seen a coherent interface between the Nb based particle and Al. The lattice mismatch between Nb-based particle and Al matrix is 0.1%. Such small lattice mismatch between a foreign solid phase and Al suggests that these particles could act as effective heterogeneous nucleation sites.

Example 24: Processing of Al—Nb—B Master Alloys

In addition to alloys described in Example 6, master alloys with compositions given in Table 4 have been prepared. Nb metallic powder and Boron in the form of $KBF_4$ are added to aluminium liquid with required quantities shown in Table 4. The melt is cast to produce Al—Nb—B master alloys. All these master alloys have been tested with grain refinement for LM6 alloy and another alloy where Si is ~10%. Grain sizes are measured with ruler and the error is ±0.05 mm.

TABLE 4

| Master alloy | Nb addition level (wt %) | | | | |
|---|---|---|---|---|---|
| composition | 0 | 0.01 | 0.025 | 0.05 | 0.1 |
| Al—1Nb—1B | 3-4 mm | 1 mm | 0.8 mm | 0.7 mm | 0.35 mm |
| Al—1Nb—3B | 3-4 mm | 0.9 mm | 0.6 mm | 0.4 mm | 0.3 mm |
| Al—1Nb—4B | 3-4 mm | 0.9 mm | 0.6 mm | 0.4 mm | 0.3 mm |
| Al—2Nb—1B | 3-4 mm | 1 mm | 0.65 mm | 0.5 mm | 0.4 mm |
| Al—2Nb—4B | 3-4 mm | — | 0.6 mm | 0.4 mm | — |
| Al—3Nb—1B | 3-4 mm | — | 0.6 mm | 0.4 mm | — |

Example 25: Processing of Al—Nb—B Master Alloy Through the Addition of Boron to Al—Nb Master Alloy A commercial Al-10Nb master alloy is melted at 900° C. and added pure Al to dilute the alloy to form Al-2Nb master alloy. Then the 1 wt % Boron is added to the melt to with an aim to reach the master alloy composition of Al-2Nb—B. Alloy is cast into cast iron mould. FIG. 43 shows the microstructure of this alloy, revealing needle shaped aluminides ($Al_3Nb$) and borides particles. This master alloy is added to Al-10Si alloy to verify the grain refinement. Grain refinement is confirmed for this master alloy.

Example 26: Mg Based Alloys

The following Mg alloys have been cast with and without 0.1 wt % Nb+0.1 wt % B addition with TP1 mould at pouring temperature of 660° C. Grain refinement has been observed for all these alloys.

| Al-containing Mg alloys | | | |
|---|---|---|---|
| AZ91 | 9Al | 1Zn | bal. Mg |
| AZ31 | 3Al | 1Zn | bal. Mg |
| AZ61 | 6Al | 1Zn | bal. Mg |
| AJ62 | 6Al | 2Sr | bal. Mg |
| AM60 | 6Al | 0.13-0.6 Mn | bal. Mg |

The invention claimed is:

1. A method of producing a masterbatch alloy for refining the grain size of a bulk alloy which is (i) an alloy comprising aluminium and at least 3% w/w silicon or (ii) an alloy comprising magnesium, comprising the step of:

(a) adding sufficient niobium and boron to a portion of an alloy comprising aluminum and at least 3% w/w silicon or (ii) an alloy comprising magnesium in order to form niobium diboride and $Al_3Nb$, to refine the grain size of the alloy.

2. The method as claimed in claim 1, wherein the alloy which is being refined comprises aluminium and silicon and wherein at least some of the niobium diboride reacts to form $Al_3Nb$.

3. The method as claimed in claim 1, wherein the alloy which is being refined comprises magnesium and aluminium.

4. The method as claimed in claim 1, wherein the amount of niobium diboride is at least 0.001% by weight of the alloy.

5. The method as claimed in claim 1, wherein said amount of niobium diboride is no more than 10% by weight of the alloy.

6. The method as claimed in claim 1, wherein the alloy comprises aluminium and from 3 to 25 wt % silicon.

* * * * *